US011566621B1

(12) United States Patent
Noh et al.

(10) Patent No.: US 11,566,621 B1
(45) Date of Patent: Jan. 31, 2023

(54) ROTARY COMPRESSOR

(71) Applicant: LG ELECTRONICS INC., Seoul (KR)

(72) Inventors: Kiyoul Noh, Seoul (KR); Minho Lee, Seoul (KR); Bumdong Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/880,801

(22) Filed: Aug. 4, 2022

(30) Foreign Application Priority Data

Oct. 21, 2021 (KR) ..... 10-2021-0141167

(51) Int. Cl.
*F04C 18/34* (2006.01)
*F04C 18/356* (2006.01)
(Continued)

(52) U.S. Cl.
CPC ..... *F04C 18/3445* (2013.01); *F04C 18/3442* (2013.01); *F04C 29/124* (2013.01);
(Continued)

(58) Field of Classification Search
CPC ..... F04C 18/3445; F04C 18/3442; F04C 18/356; F04C 18/3447; F04C 2/321;
(Continued)

(56) References Cited

U.S. PATENT DOCUMENTS

2016/0084249 A1* 3/2016 Muramatsu ..... F04C 15/06 418/26

FOREIGN PATENT DOCUMENTS

JP 64-60788 3/1989
JP 2000-337267 12/2000
(Continued)

OTHER PUBLICATIONS

Korean Office Action dated Oct. 4, 2022.

*Primary Examiner* — Deming Wan
(74) *Attorney, Agent, or Firm* — Ked & Associates

(57) ABSTRACT

A rotary compressor may include a cylinder having an inner peripheral surface defined in an annular shape to define a compression space, and a suction port that extends in a lateral direction to communicate with the compression space and through which refrigerant is suctioned into the compression space; a roller rotatably provided in the compression space of the cylinder, and having a plurality of vane slots that provides a back pressure at one side thereinside provided at a predetermined interval along an outer peripheral surface of the roller; a plurality of vanes slidably inserted into the plurality of vane slots, respectively, to rotate together with the roller, front end surfaces of which come into contact with the inner peripheral surface of the cylinder due to the back pressure to partition the compression space into a plurality of compression chambers; and a main bearing and a sub bearing provided at ends of the cylinder and in contact with surfaces of the plurality of vanes, respectively, and spaced apart from each other to define surfaces of the compression space, respectively. At least one surface of the vane in contact with the main bearing and the sub bearing may be a curved surface having a predetermined curvature.

20 Claims, 13 Drawing Sheets

(51) Int. Cl.

| | |
|---|---|
| ***F04C 2/32*** | (2006.01) |
| ***F04C 2/344*** | (2006.01) |
| ***F04C 18/344*** | (2006.01) |
| ***F04C 29/12*** | (2006.01) |
| *F04C 23/00* | (2006.01) |

(52) U.S. Cl.
CPC ..... *F04C 23/008* (2013.01); *F04C 2210/26* (2013.01); *F04C 2240/50* (2013.01)

(58) Field of Classification Search
CPC ..... F04C 2/322; F04C 2/324; F04C 2/344; F04C 2/3445; F04C 2/3447
See application file for complete search history.

(56) References Cited

FOREIGN PATENT DOCUMENTS

| | | |
|---|---|---|
| JP | 2014-125962 | 7/2014 |
| KR | 10-2223283 | 3/2021 |

* cited by examiner

ROTARY COMPRESSOR

CROSS-REFERENCE TO RELATED APPLICATION(S)

Pursuant to 35 U.S.C. § 119(a), this application claims the benefit of an earlier filing date of and the right of priority to Korean Patent Application No. 10-2021-0141167, filed in Korea on Oct. 21, 2021, the contents of which is incorporated by reference herein in its entirety.

BACKGROUND

1. Field

A rotary compressor is disclosed herein.

2. Background

A compressor may be divided into a reciprocating compressor, a rotary compressor, and a scroll compressor according to a method of compressing a fluid, such as refrigerant. The reciprocating compressor uses a method in which a compression space is disposed between a piston and a cylinder, and the piston linearly reciprocates to compress a fluid, the rotary compressor uses a method of compressing a fluid by a roller that eccentrically rotates inside of a cylinder, and the scroll compressor uses a method in which a pair of spiral scrolls engage and rotate to compress a fluid.

Among them, the rotary compressor may be divided according to a method in which the roller rotates with respect to the cylinder. For example, the rotary compressor may be divided into an eccentric rotary compressor in which a roller rotates eccentrically with respect to a cylinder, and a concentric rotary compressor in which a roller rotates concentrically with respect to a cylinder.

In addition, the rotary compressor may be divided according to a method of dividing a compression chamber. For example, it may be divided into a vane rotary compressor in which vanes come into contact with a roller or a cylinder to partition a compression space, and an elliptical rotary compressor in which a portion of an elliptical roller comes into contact with a cylinder to partition a compression space.

Japanese Patent Laid-Open No. 2014-125962, which is hereby incorporated by reference, discloses a low-pressure type vane rotary compressor. The rotary compressor as described is provided with a drive motor, a rotational shaft is coupled to a rotor of the drive motor, and a rotational force of the drive motor is transmitted to a roller through the rotational shaft to compress refrigerant.

In the related art rotary compressor, a vane protrudes to an inner surface of a cylinder while rotating at high speed together with a rotor, and a front end portion of the vane comes into contact with an inner periphery of the cylinder. A bush support portion having a cylindrical shape in parallel to a central shaft of the rotor portion is provided in a vicinity of an outer periphery of the rotor portion, and the vane is supported therein through a pair of bushes having a substantially semi-cylindrical shape.

Further, a vane aligner protrusion is fitted into a groove disposed on a rear surface of the vane, so that the vane is supported to have a predetermined inclination with respect to a normal direction of an inner periphery thereof or a normal direction of an inner periphery of the cylinder during rotation.

A curvature of the front end portion of the vane is substantially the same as that the inner periphery of the cylinder, and a compression operation is carried out while a front end of the vane and a normal line of the inner periphery of the cylinder almost matched all the time, and there is known a rotary compressor having a structure in which at least one vane aligner is integrally configured with the vane such that the front end of the vane and the inner periphery of the cylinder can be made non-contact with each other.

Such a rotary compressor in the related art has a problem in that the cost increases due to the addition of a component, such as a vane aligner. Further, as the vane aligner protrusion is fitted into the groove on the rear surface of the vane, the vane aligner rotates together, thereby causing friction on an end surface and a side surface of the aligner. In addition, there is a problem in that movement of the vane is constrained by the aligner protrusion to transfer stress to the protrusion, resulting in a reliability problem.

On the other hand, in a vane rotary compressor in the related art, during a compression process, the vanes have rotating, protruding and retracting movements which cause a lot of friction in this process. The front end portion of the vane rotates at high speed in contact with an inner surface of the cylinder to cause friction on a side surface of the vane by contact with a vane slot in the roller. In particular, as the vanes rotate in an inclined state, when a mechanical portion is disassembled to check a degree of wear after a type of compressor operation, an end surface of a bearing in contact with each of upper and lower ends of the vane has a problem that a dark wear scar that is the same as that of a rotational region of the vane is generated.

In order to solve this problem, development of a rotary compressor having a structure capable of reducing the wear of the bearing is required. In addition, development of a high-efficiency rotary compressor capable of minimizing loss by improving the lubricating properties of the cross section during the rotation of the vane is required.

BRIEF DESCRIPTION OF THE DRAWINGS

Embodiments will be described in detail with reference to the following drawings in which like reference numerals refer to like elements, and wherein.

DETAILED DESCRIPTION

Figure 1:
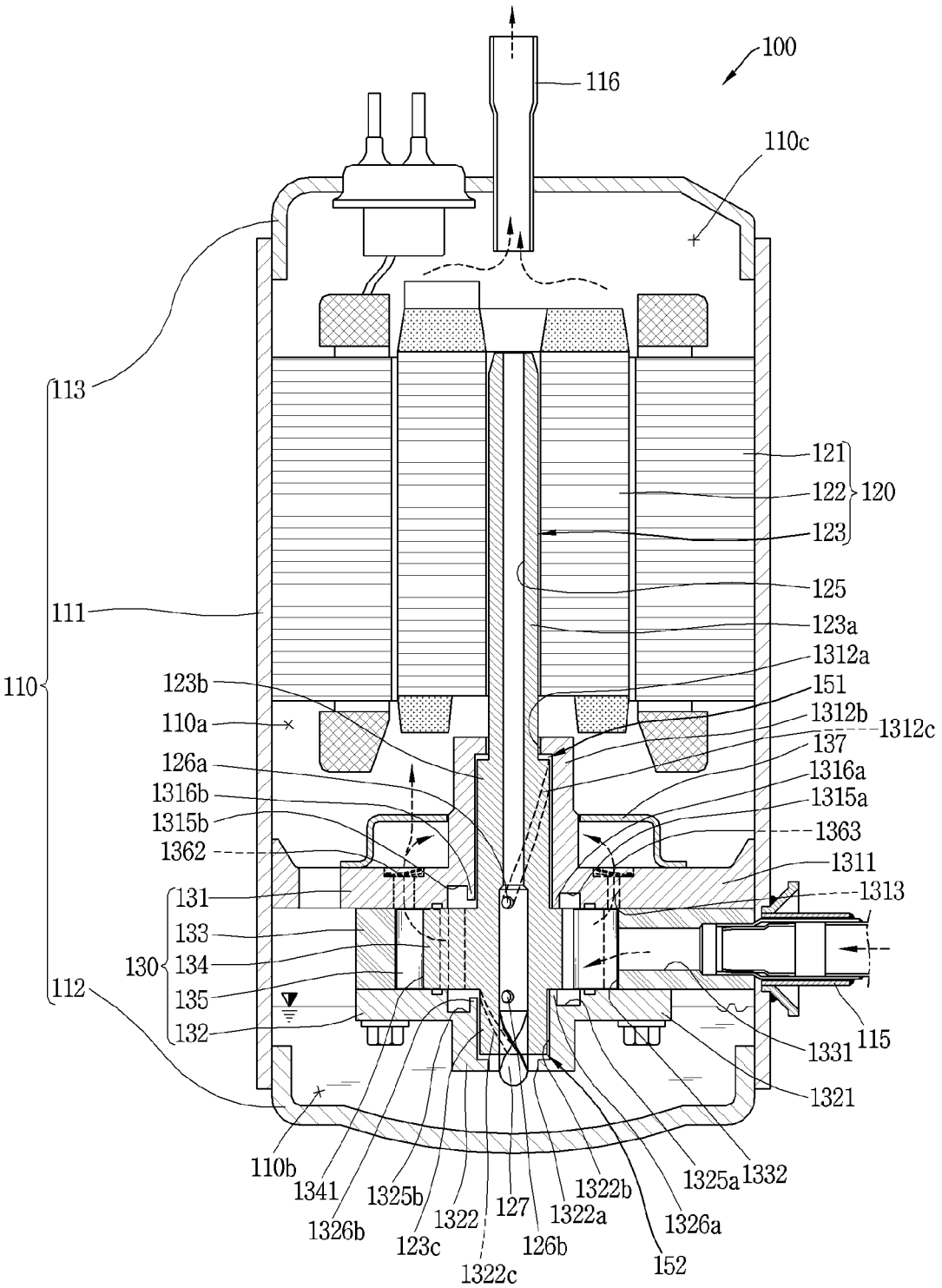
FIG. 1 is a longitudinal cross-sectional view of a rotary compressor according to an embodiment.

In the present specification, the same or similar reference numerals are assigned to the same or similar components in different embodiments, and redundant description thereof has been omitted. Further, structure applied to any one embodiment may be also applied in the same manner to another embodiment as long as they do not structurally or functionally contradict each other even in different embodiments.

A singular representation may include a plural representation unless it represents a definitely different meaning from the context.

In describing an embodiment disclosed herein, moreover, description has been omitted when specific description for publicly known technologies to which the invention pertains is judged to obscure the gist.

The accompanying drawings are provided only for a better understanding of the embodiments disclosed herein and are not intended to limit technical concepts disclosed herein, and therefore, it should be understood that the accompanying drawings include all modifications, equivalents and substitutes within the concept and technical scope.

Figure 2:
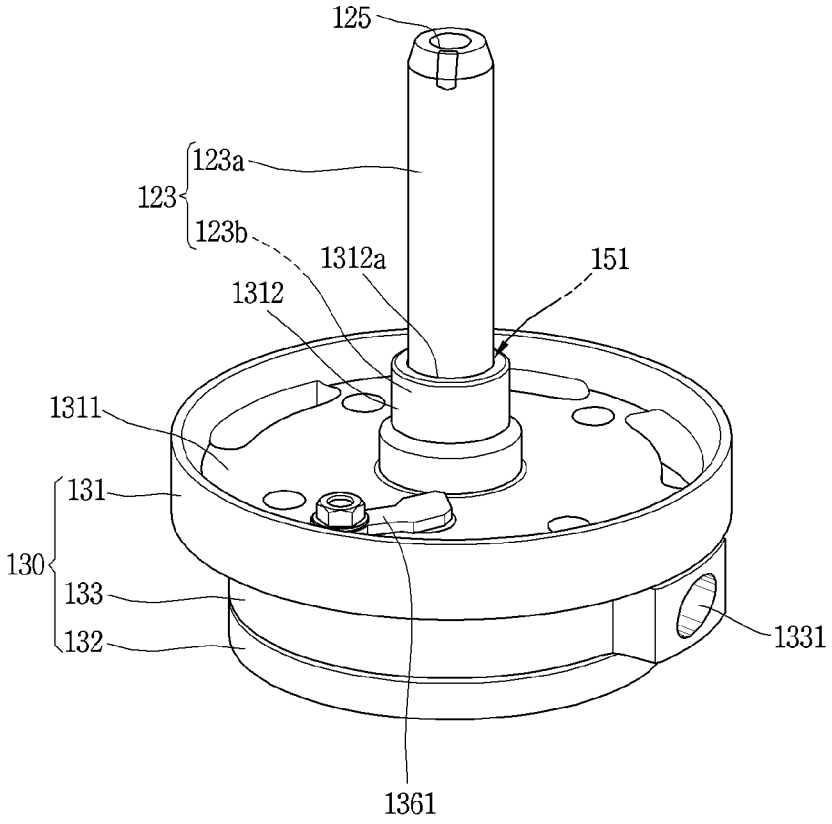
FIG. 2 is a perspective view of a compression unit of the rotary compressor of FIG. 1.
Figure 3:
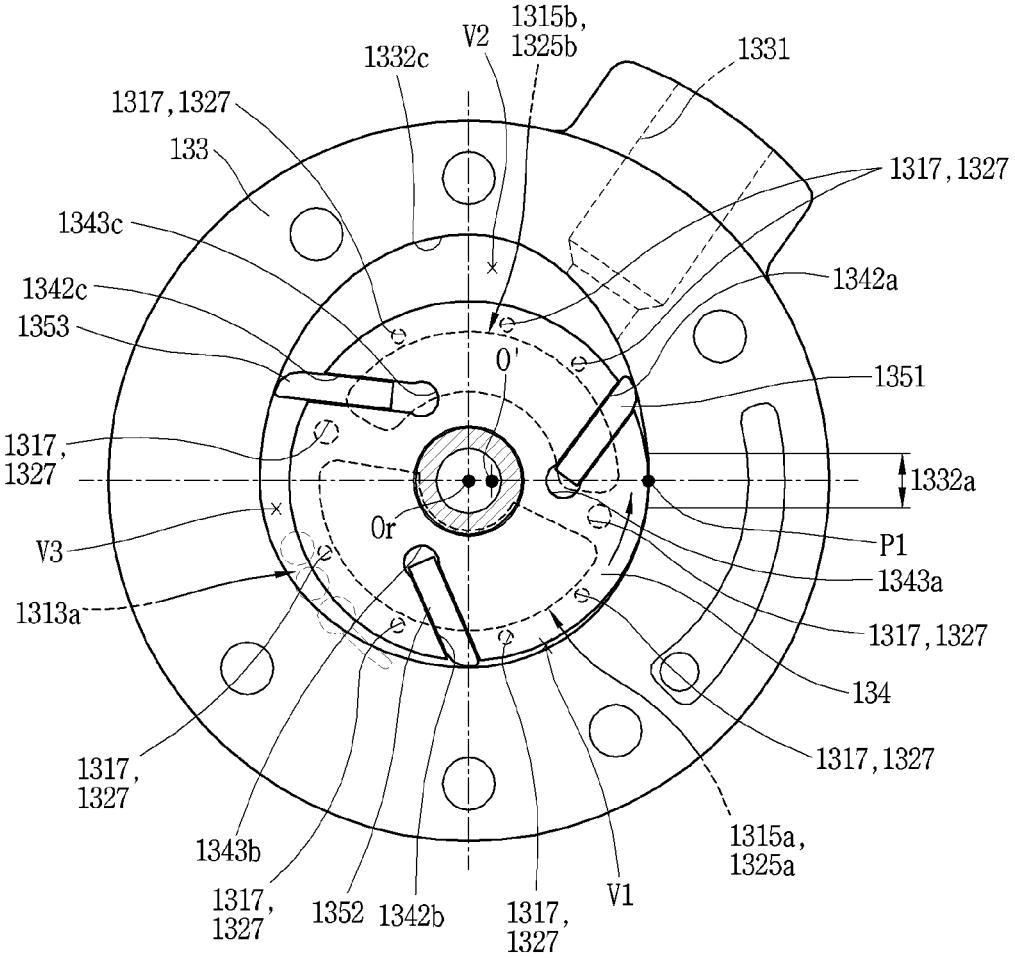
FIG. 3 is a transverse cross-sectional view of the compression unit of the rotary compressor of FIG. 1.
Figure 4:
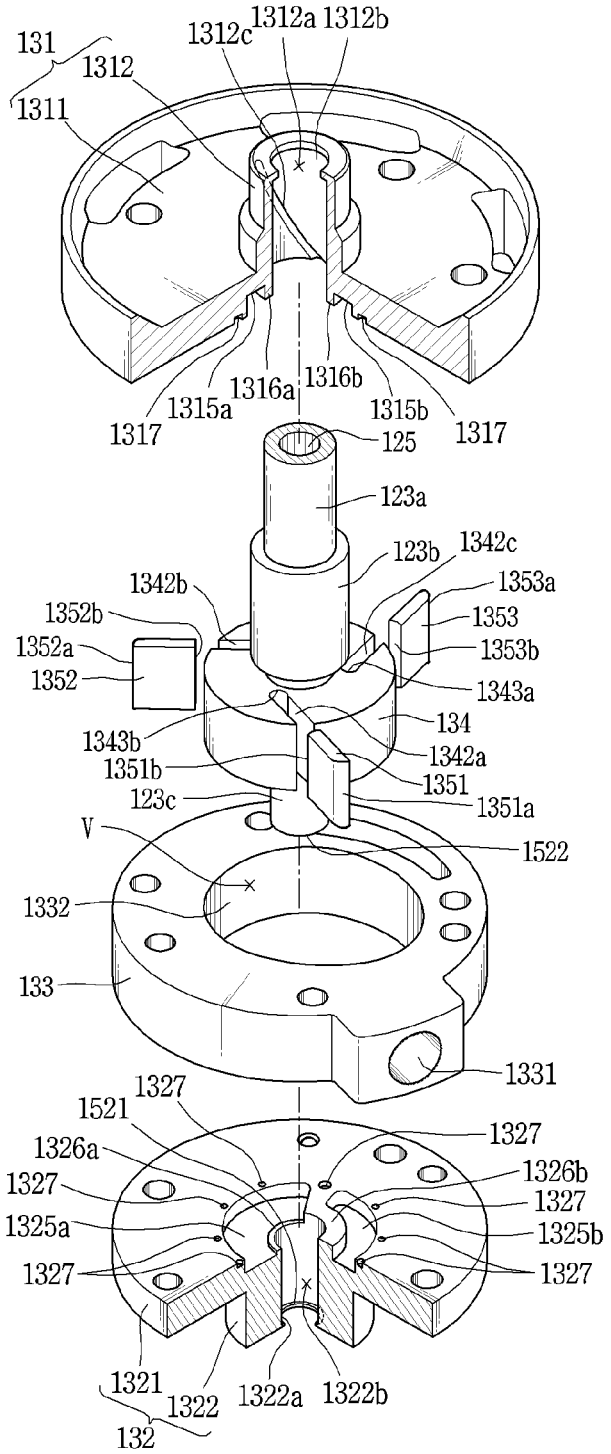
FIG. 4 is an exploded perspective view of the compression unit of the rotary compressor of FIG. 1.

FIG. 1 is a longitudinal cross-sectional view of a rotary compressor according to an embodiment. FIG. 2 is a perspective view of a compression unit of the rotary compressor of FIG. 1. FIG. 3 is a transverse cross-sectional view of the compression unit of the rotary compressor of FIG. 1. FIG. 4 is an exploded perspective view of the compression unit of the rotary compressor of FIG. 1.

Hereinafter, rotary compressor 100 according to an embodiment will be described with reference to FIGS. 1 to 5. The rotary compressor 100 according to an embodiment may be a vane rotary compressor 100.

Referring to FIGS. 3 and 4, the rotary compressor 100 may include a cylinder 133, a roller 134, a plurality of vanes 1351, 1352, 1353, a main bearing 131, and a sub bearing 132. The cylinder 133 may be configured with an annular inner peripheral surface to define a compression space V. Further, the cylinder 133 may include a suction port 1331, and the suction port 1331 may be disposed to communicate with the compression space V to suction refrigerant and provide it to the compression space V.

Referring to FIG. 3, an inner peripheral surface 1332 of the cylinder 133 may be defined in an elliptical shape, and an inner peripheral surface 1332 of the cylinder 133 according to an embodiment may be combined such that a plurality of ellipses, for example, four ellipses having different major and minor ratios have two origins to define an asymmetric elliptical shape, and description of the shape of the inner peripheral surface of the cylinder 133 will be described hereinafter.

The roller 134 may be rotatably provided in the compression space V of the cylinder 133. In addition, the roller 134 may be configured with a plurality of vane slots 1342*a*, 1342*b*, 1342*c* at a predetermined interval along an outer peripheral surface. Further, the compression space V may be defined between an inner periphery of the cylinder 133 and an outer periphery of the roller 134.

That is, the compression space V may be a space defined between the inner peripheral surface of the cylinder 133 and the outer peripheral surface of the roller 134. In addition, the compression space V may be divided into spaces as many as the number of vanes 1351, 1352, 1353 by the plurality of vanes 1351, 1352, 1353.

For example, referring to FIG. 3, an example is shown in which the compression space V is partitioned into a first compression space V1 to a third compression space V3.

The vanes 1351, 1352, 1353 may be slidably inserted into the vane slots 1342*a*, 1342*b*, 1342*c*, and configured to rotate together with the roller 134. In addition, a back pressure may be provided at a rear end surface 1351*b*, 1352*b*, 1353*b* of the vane 1351, 1352, 1353 to allow a front end surface 1351*a*, 1352*a*, 1353*a* of the vane 1351, 1352, 1353 to come into contact with the inner periphery of the cylinder 133.

In embodiments disclosed herein, a plurality of vanes 1351, 1352, 1353 are provided in plurality to define a multi-back pressure structure, and the front end surfaces 1351*a*, 1352*a*, 1353*a* of the plurality of vanes 1351, 1352, 1353 come into contact with the inner periphery of the cylinder 133, thereby allowing the compression space V to be partitioned into the plurality of compressed spaces V1, V2, V3. An example in which three vanes 1351, 1352, 1353 are provided is illustrated in FIG. 3, for example, thereby allowing the compression space V to be partitioned into the three compression spaces V1, V2, V3. Further, a thickness of the vane 1351, 1352, 1353 may be, for example, 3 mm.

In addition, at least one surface of the vane 1351, 1352, 1353 coming into contact with the main bearing 131 and the sub bearing 132 described hereinafter may be defined as a curved surface 1351*c*, 1351*d*. The curved surface 1351*c*, 1351*d* had a predetermined curvature.

On the curved surface 1351*c*, 1351*d* of the vane 1351, 1352, 1353, a distance from both sides where a curvature starts to a tangent to the curvature may be greater than an assembly tolerance between a surface of the vane 1351, 1352, 1353 and the main bearing 131 and the sub bearing 132, but less than or equal to 0.2 mm, which will be described hereinafter.

The main bearing 131 and the sub bearing 132 may be respectively provided at both ends of the cylinder 133. The main bearing 131 and the sub bearing 132 may be disposed to be spaced apart from each other to constitute both surfaces of the aforementioned compression space V, respectively. For example, referring to FIGS. 1, 2 and 4, an example is shown in which the main bearing 131 is provided at an upper end of the cylinder 133 to define an upper surface of the compression space V, and the sub bearing 132 is provided at a lower end of the cylinder 133 to define a lower surface of the compression space V.

In the main bearing 131 and the sub bearing 132 in contact with the surfaces of the vanes 1351, 1352, 1353 during rotation of the vanes 1351, 1352, 1353, groove portions (grooves) 1317, 1327 connected to (that face) the curved surface 1351*c*, 1351*d* may be disposed. For example, as shown in FIGS. 1 and 4, an example is shown in which the main bearing 131 is provided to be in contact with the upper surfaces of the vanes 1351, 1352, 1353 at an upper end of the cylinder 133, and the sub bearing 132 is provided to be in contact with the lower surfaces of the vanes 1351, 1352, 1353 at a lower end of the cylinder 133. That is, the groove portions 1317, 1327 may be disposed on the lower surface of the main bearing 131 in contact with the upper surfaces of the vanes 1351, 1352, and 1353, and disposed on the upper surface of the sub bearing in contact with the lower surfaces of the vanes 1351, 1352, 1353. In FIGS. 3 to 5 and 7, an example is shown in which the groove portions 1317, 1327 are disposed on both the lower surface of the main bearing 131 and the upper surface of the sub bearing 132.

The groove portion 1317, 1327 may be disposed to be spaced apart from outer peripheries of the main bearing 131 and the sub bearing 132 by a predetermined distance on one surface in contact with the surface of the vane 1351, 1352, 1353 during the rotation of the vane 1351, 1352, 1353. Further, a plurality of the groove portion 1317, 1327 may be provided, and the plurality of groove portions 1317, 1327 may be disposed to be spaced apart from one another by a predetermined distance along a circumferential direction.

Figure 5:
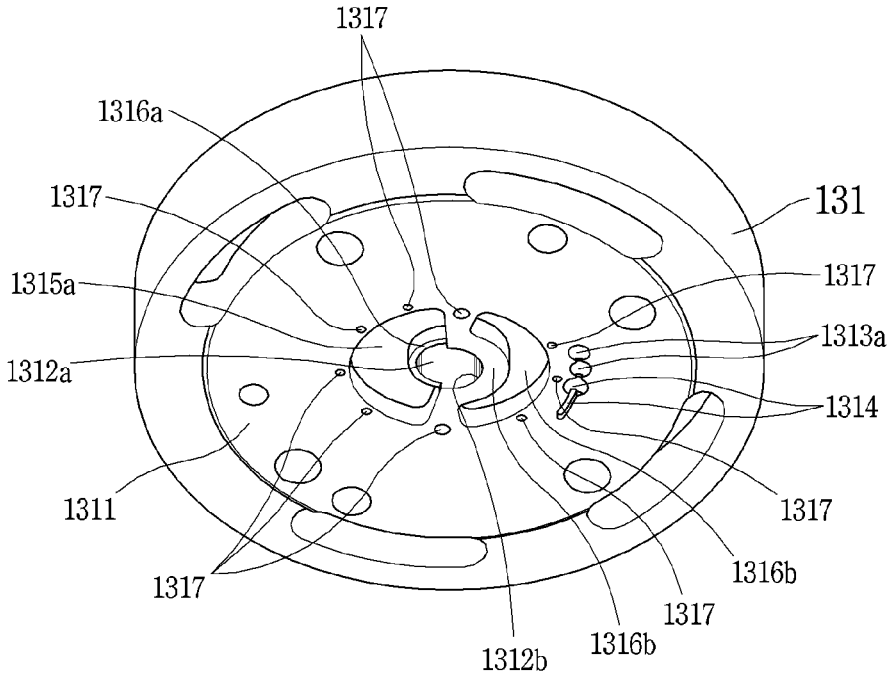
FIG. 5 is a perspective view showing a bottom surface of a main bearing in FIG. 4.
Figure 6:
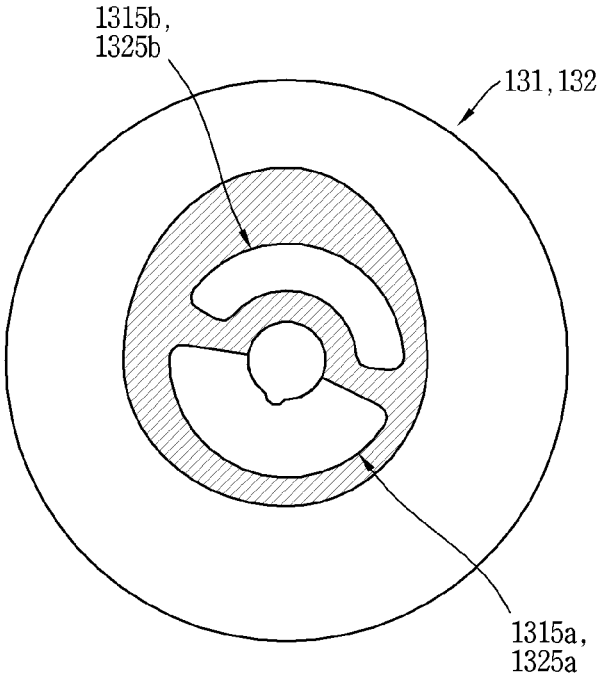
FIG. 6 is a conceptual view showing a friction region on a cross section of a vane and a main/sub bearing in the compression unit of the rotary compressor of FIG. 1.

Referring to FIGS. 3 to 5, an example is shown in which nine groove portions 1317, 1327 are arranged to be spaced apart from one another in the circumferential direction. Among the nine groove portions 1317, 1327, some of the groove portions 1317, 1327 may be defined to be relatively larger than the other groove portions 1317, 1327.

FIG. 3 shows an example in which two large groove portions 1317, 1327 are disposed in a left-right or lateral direction, and the remaining seven small groove portions 1317, 1327 are disposed. FIG. 5 shows an example in which the groove portions are partially rotated with respect to FIG. 3 and two large groove portions 1317, 1327 are disposed in an up-down direction The relatively large groove portions 1317, 1327 may be disposed, for example, between a first main back pressure pocket 1315*a* and a second main back pressure pocket 1315*b* or between a first sub back pressure pocket 1325*a* and a second sub back pressure pocket 1325*b*. A section in which the relatively large groove portions 1317, 1327 are disposed may have a wider cross-sectional friction area compared to the other section, and thus, may be expected to have an effect of reducing friction between the cylinder 133 and the main bearing 131, and between the cylinder 133 and the sub bearing 131 at portions in which the large groove portions 1317, 1327 are disposed.

For example, the groove portion 1317, 1327 may have a depth of greater than 0.1 mm but less than or equal to 5 mm. As the depth of the groove portions 1317, 1327 increases, a dead volume increases, it should be 5 mm or less.

At least one of the main bearing 131 or the sub bearing 132 may be provided with at least one of back pressure pockets 1315*a*, 1315*b*, 1325*a*, 1325*b* concavely disposed to communicate with the compression space V. Further, the groove portion 1317, 1327 may be disposed to be spaced apart from the back pressure pocket 1315*a*, 1315*b*, 1325*a*, 1325*b*.

The main bearing 131 may include a main plate portion 1311 coupled to the cylinder 133 to cover an upper side of the cylinder 133. In addition, the back pressure pocket 1315*a*, 1315*b*, 1325*a*, 1325*b* may include first main back pressure pocket 1315*a* and second main back pressure pocket 1315*b*.

The first main back pressure pocket 1315*a* and the second main back pressure pocket 1315*b* may be disposed to be spaced apart from each other at a predetermined distance on a lower surface of the main plate portion 1311. The first main back pressure pocket 1315*a* may define a discharge back pressure, and the second main back pressure pocket 1315*b* may define an intermediate back pressure.

The lower surface of the main plate portion 1311 may be understood as a surface defining a compression space on an inner periphery of the cylinder 133. Further, the plurality of groove portions 1317, 1327 may be disposed along the circumferential direction to be spaced apart from the outer peripheries of the first main back pressure pocket 1315*a* and the second main back pressure pocket 1315*b*.

In FIG. 5, an example in which the main bearing 131 includes the main plate portion 1311 in a disk shape is shown, an example in which the first and second main back pressure pockets 1315*a*, 1315*b* are spaced apart from each other at a predetermined interval and defined in a half-moon shape on a lower surface of the main plate portion 1311 is shown, and an example in which nine groove portions 1317, 1327 are disposed to be spaced apart from one another on outer peripheries of the first and second main back pressure pockets 1315*a*, 1315*b* is shown.

Figure 11:
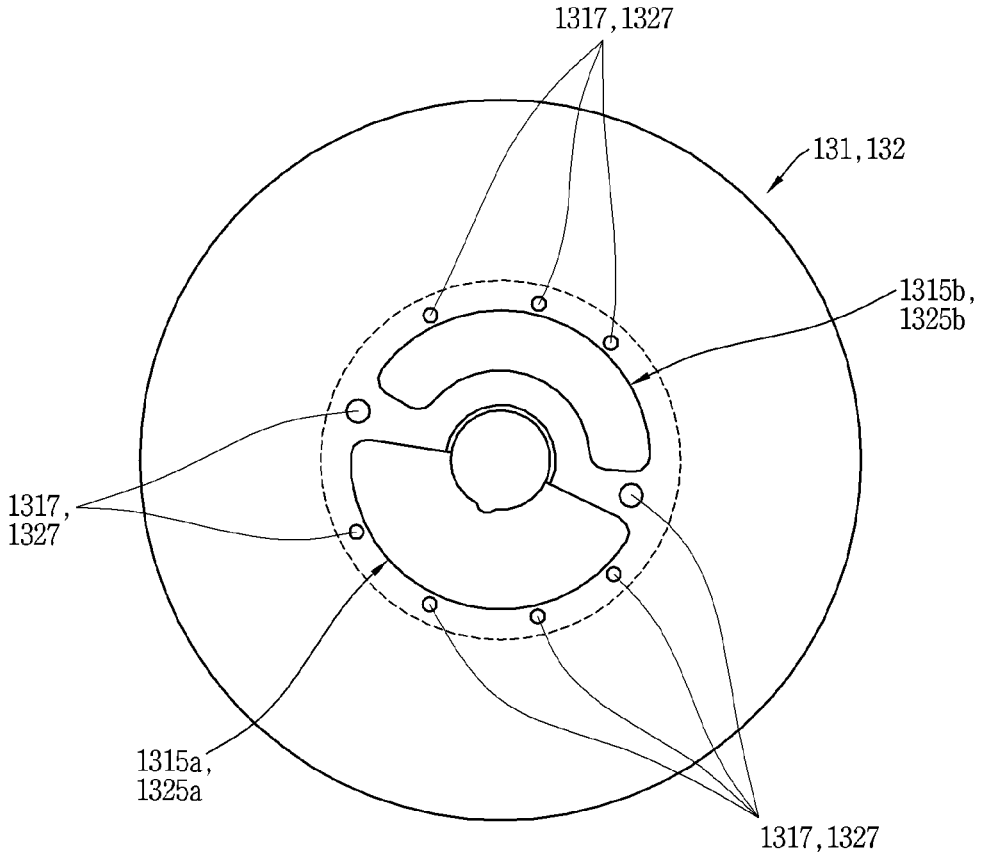
FIG. 11 is a plan view showing an example in which a groove portion is disposed in a leakage preventing region in FIG. 10.

On the other hand, referring to FIGS. 3 and 11, the main bearing 131 and the sub bearing 132 may be provided with a leakage length (defined in a dotted line in FIG. 11) in a radial direction between an outer periphery of the back pressure pocket 1315*a*, 1315*b*, 1325*a*, 1325*b* and the compression chamber V. The groove portion 1317, 1327 must be defined to be smaller than the leakage length.

The leakage length may be 3 mm in the radial direction. In this case, when a diameter of the groove portion 1317, 1327 is 3 mm or more, leakage occurs because the groove portion becomes a communication path, and thus, the groove portion 1317, 1327 must have a diameter of 3 mm or less. That is, the diameter of the groove portion 1317, 1327 is defined to be smaller than a value obtained by dividing a difference value between a diameter of the roller 134 and an outer diameter of the back pressure pocket 1315*a*, 1315*b*, 1325*a*, 1325*b* by two.

In addition, the sub bearing may include a sub plate portion 1321 coupled to the cylinder 133 to cover a lower side of the cylinder 133. The back pressure pocket 1315*a*, 1315*b*, 1325*a*, 1325*b* may include first sub back pressure pocket 1325*a* and second sub back pressure pocket. The first sub back pressure pocket 1325*a* and the second sub back pressure pocket 1325*b* may be disposed to be spaced apart from each other at a predetermined distance on an upper surface of the sub plate portion 1321, and the first sub back pressure pocket 1325*a* may define a discharge back pressure, and the second sub back pressure pocket 1325*b* may define an intermediate back pressure.

The upper surface of the sub plate portion 1321 may be understood as a surface defining a compression space on an inner periphery of the cylinder 133. Further, the plurality of groove portions 1317, 1327 may be disposed along the circumferential direction to be spaced apart from the outer peripheries of the first sub back pressure pocket 1325*a* and the second sub back pressure pocket 1325*b*.

In FIG. 4, an example in which the sub bearing includes the sub plate portion 1321 in a disk shape is shown, an example in which the first and second sub back pressure pockets are spaced apart from each other at a predetermined interval and defined in a half-moon shape on an upper surface of the sub plate portion 1321 is shown, and an example in which nine groove portions 1317, 1327 are disposed to be spaced apart from one another on outer peripheries of the first and second sub back pressure pockets 1325*a*, 1325*b* is shown. By defining the groove portion 1317, 1327 on an end surface of the main bearing 131 and the sub bearing 132 in contact with the vane 1351, 1352, 1353, some oil is recovered from a portion between the vane 1351, 1352, 1353 and the vane slot 1342*a*, 1342*b*, 1342*c*, in which a hydraulic pressure increases, to reduce the hydraulic pressure, thereby improving an overall lubrication environment through the oil accumulated in the groove portion 1317, 1327.

Hereinafter, the rotary compressor 100 will be further described.

Referring to FIG. 1, the rotary compressor 100 according to an embodiment may further include a casing 110 and a drive motor 120 provided inside of the casing 110 to generate rotational power. The drive motor 120 may be provided in an upper inner space 110*a* of the casing 110, and the compression unit 130 in a lower inner space 110*b* of the casing 110, respectively, and the drive motor 120 and the compression unit 130 may be connected by a rotational shaft 123.

The casing 110, which is a portion constituting an exterior of the compressor, may be divided into a vertical or horizontal type depending on an aspect of installing the compressor. The vertical type has a structure in which the drive motor 120 and the compression unit 130 are disposed at upper and lower sides along an axial direction, and the horizontal type has a structure in which the drive motor 120 and the compression unit 130 are disposed at left and right or lateral sides. The casing 110 according to embodiments will mainly be described with respect to the vertical type, but the casing 110 may also be applied to the horizontal type.

The casing 110 may include an intermediate shell 111 defined in a cylindrical shape, a lower shell 112 that covers a lower end of the intermediate shell 111, and an upper shell 113 that covers an upper end of the intermediate shell 111. The drive motor 120 and the compression unit 130 may be inserted into and fixedly coupled to the intermediate shell 111, and a suction pipe 115 may be passed therethrough to be directly connected to the compression unit 130. The lower shell 112 may be sealingly coupled to a lower end of the intermediate shell 111, and a storage oil space 110*b* in which oil to be supplied to the compression unit 130 is stored may be disposed below the compression unit 130. The upper shell 113 may be sealingly coupled to an upper end of the intermediate shell 111, and an oil separation space 110*c* may be disposed above the drive motor 120 to separate oil from refrigerant discharged from the compression unit 130.

The drive motor 120, which is a portion constituting the electric motor unit, provides power to drive the compression unit 130. The drive motor 120 may include a stator 121, a rotor 122, and the rotational shaft 123.

The stator 121 may be fixedly provided inside of the casing 110, and may be, for example, press-fitted and fixed to an inner peripheral surface of the casing 110 by a method, such as shrink fitting, for example. For example, the stator 121 may be, for example, press-fitted and fixed to an inner peripheral surface of the intermediate shell 111.

The rotor 122 may be rotatably inserted into the stator 121, and the rotational shaft 123 may be, for example, press-fitted and coupled to a center of the rotor 122. Accordingly, the rotational shaft 123 may rotate concentrically together with the rotor 122.

An oil flow path 125 is defined in a hollow hole shape at the center of the rotational shaft 123, and oil through holes 126*a*, 126*b* may be disposed to pass therethrough toward an outer peripheral surface of the rotational shaft 123 in a middle of the oil flow path 125. The oil through holes 126*a*, 126*b* may include first oil through hole 126*a* belonging to a range of a main bush portion 1312 and second oil through hole 126*b* belonging to a range of a second bearing portion 1322, which will be described hereinafter. Each of the first oil through hole 126*a* and the second oil through hole 126*b* may be configured as one or a plurality. This embodiment shows an example that is configured as a plurality of oil through holes.

An oil pickup 127 may be provided in the middle or at a lower end of the oil flow path 125. For example, the oil pickup 127 may include one of a gear pump, a viscous pump, or a centrifugal pump. This embodiment shows an example to which a centrifugal pump is applied. Accordingly, when the rotational shaft 123 rotates, oil filled in the oil storage space 110*b* of the casing 110 may be pumped by the oil pickup 127, and the oil may be suctioned up along the oil flow path 125 and then supplied to a sub bearing surface 1322*b* of the sub bush portion 1322 through the second oil through hole 126*b*, and to a main bearing surface 1312*b* of the main bush portion 1312 through the first oil through hole 126*a*.

Further, the rotational shaft 123 may be integrally formed with the roller 134 or the roller 134 may be press-fitted and post-assembled thereto, for example. In this embodiment, an example is described in which the roller 134 is integrally formed with the rotational shaft 123, but the roller 134 will be described hereinafter.

In the rotational shaft 123, a first bearing support surface (not shown) may be disposed at an upper half portion of the rotational shaft 123 with respect to the roller 134, that is, between a main shaft portion 123*a* press-fitted into the rotor 122 and a main bearing portion 123*b* extending toward the roller 134 from the main bearing portion 123*b* formed between the bearing portion 123*b*, and a second bearing support surface (not shown) may be disposed at a lower half portion of the rotational shaft 123 with respect to the roller 134, that is, on the rotational shaft 123 at a lower end of the sub bearing 132. The first bearing support surface constitutes a first axial support portion 151 together with a first shaft support surface (not shown) described hereinafter, and the second bearing support surface constitutes a second shaft support portion 152 together with a second shaft support surface (not shown) described hereinafter. The first bearing support surface and the second bearing support surface will be described hereinafter together with the first axial support portion 151 and the second axial support portion 152.

As described above, at least one of the main bearing 131 or the sub bearing 132 may be provided with at least one of back pressure pockets 1315*a*, 1315*b*, 1325*a*, 1325*b* concavely disposed to communicate with the compression space V.

The back pressure chamber 1343*a*, 1343*b*, 1343*c* may be disposed at an inner end of the vane slot 1342*a*, 1342*b*, 1342*c*. The back pressure chamber 1343*a*, 1343*b*, 1343*c* receives a back pressure from the back pressure pocket 1315*a*, 1315*b*, 1325*a*, 1325*b* while communicating with the back pressure pocket 1315*a*, 1315*b*, 1325*a*, 1325*b* to pressurize the vane 1351, 1352, 1353 toward the inner periphery of the cylinder 133.

The back pressure chamber 1343*a*, 1343*b*, 1343*c*, which is provided at the inner end of the vane slot 1342*a*, 1342*b*, 1342*c*, may be understood as a space defined between the rear end surface 1351*b*, 1352*b*, 1353*b* of the vane 1351, 1352, 1353 and the inner end of the vane slot 1342*a*, 1342*b*, 1342*c*.

The back pressure chambers 1343*a*, 1343*b*, 1343*c* may be communicable with first and second main back pressure pockets 1315*a*, 1315*b* and first and second sub back pressure pockets 1325*a*, 1325*b* to receive back pressures from the first and second main back pressure pockets 1315*a*, 1315*b* and the first and second sub back pressure pockets 1325*a*, 1325*b* in such a manner that the front end surfaces 1351*a*,

1352*a*, 1353*a* of the vanes 1351, 1352, 1353 may be disposed to be in contact with the inner periphery of the cylinder 133 or to be spaced apart from the inner periphery of the cylinder 133 by a predetermined distance.

At least a portion of the back pressure chamber 1343*a*, 1343*b*, 1343*c* may be defined as an arc surface, and a diameter of the arc surface of the back pressure chamber 1343*a*, 1343*b*, 1343*c* may be smaller than a distance between the first and second main back pressure pockets 1315*a*, 1315*b*. Due to this, when communicating with the first main back pressure pocket 1315*a* at high pressure by a discharge back pressure to receive the discharge back pressure while at the same time communicating with the second main back pressure pocket 1315*b*, an intermediate pressure of the second main back pressure pocket 1315*b* may be received as well to prevent a back pressure at the rear end surface 1351*b*, 1352*b*, 1353*b* of the vanes 1351, 1352, 1353 from being excessively increased.

In FIG. 3, an example is illustrated in which the back pressure chamber 1343*a*, 1343*b*, 1343*c* is connected to the vane slot 1342*a*, 1342*b*, 1342*c* while having an arc surface, and a diameter of the arc surface of the back pressure chamber 1343*a*, 1343*b*, 1343*c* is smaller than a distance between the first and second main back pressure pockets 1315*a*, 1315*b*. For example, when a high back pressure is received from the first main back pressure pocket 1315*a* and the first sub back pressure pocket 1325*a*, the vane 1351, 1352, 1353 may be maximally drawn out such that front end surface 1351*a*, 1352*a*, 1353*a* of the vane 1351, 1352, 1353 comes into contact with the inner periphery of the cylinder 133, and when an intermediate back pressure is received from the second main back pressure pocket 1315*b* and the second sub back pressure pocket 1325*b*, the vane 1351, 1352, 1353 may be drawn out in a relatively small amount such that the front end surface 1351*a*, 1352*a*, 1353*a* of the vane 1351, 1352, 1353 is spaced apart from the inner periphery of the cylinder 133 by a predetermined distance.

Until the front end surface 1351*a*, 1352*a*, 1353*a* of the vane 1351, 1352, 1353 is adjacent to the suction port 1331 of the cylinder 133 such that high-pressure refrigerant at the front end surface 1351*a*, 1352*a*, 1353*a* of the vane 1351, 1352, 1353 is bypassed to the suction port 1331, the back pressure pocket 1315*a*, 1315*b*, 1325*a*, 1325*b* is in communication with the back pressure chamber 1343*a*, 1343*b*, 1343*c* to allow the front end surface 1351*a*, 1352*a*, 1353*a* of the vane 1351, 1352, 1353 to come into contact with an inner periphery of the cylinder 133, and thus a predetermined back pressure within the back pressure pocket 1315*a*, 1315*b*, 1325*a*, 1325*b* pressurizes the rear end surface 1351*b*, 1352*b*, 1353*b* of the vane 1351, 1352, 1353 through the back pressure chamber 1343*a*, 1343*b*, 1343*c*, and the front end surface 1351*a*, 1352*a*, 1353*a* of the vane 1351, 1352, 1353 comes into contact with the inner periphery of the cylinder 133 while pressurizing the same.

When the vane 1351, 1352, 1353 protrudes into the compression space during the suction and compression processes, the vane 1351, 1352, 1353 may be inclined laterally inside the vane slot 1342*a*, 1342*b*, 1342*c* due to a differential pressure, and in those processes, in the case of the vane 1351, 1352, 1353 having the existing structure, edges of upper and lower cross sections generate frictions with respect to end surfaces of the main bearing 131 and the sub bearing 132. On the contrary, in the case of embodiments disclosed herein, by defining the upper and lower ends of the vane 1351, 1352, 1353 as the curved surface 1351*c*, 1351*d* even when the vane 1351, 1352, 1353 is inclined, surface contact due to the curved surface 1351*c*, 1351*d* rather than edge contact in the related art may be allowed to increase leakage length, thereby improving oil film from being broken.

In addition, during rotation, a hydraulic pressure increases between the vane 1351, 1352, 1353 and the vane slot 1342*a*, 1342*b*, 1342*c* of the roller 134, and some oil is recovered from a portion between the vane 1351, 1352, 1353 and the vane slot 1342*a*, 1342*b*, 1342*c*, in which the hydraulic pressure increases, to reduce the hydraulic pressure, by defining the groove portion 1317, 1327 on an end surface of the main bearing 131 and sub bearing 132 in contact with the vane 1351, 1352, 1353, thereby improving an overall lubrication environment through the oil accumulated in the groove portion 1317, 1327.

According to one embodiment, an example in which the back pressure pockets 1315*a*, 1315*b*, 1325*a*, 1325*b* are provided in both the main bearing 131 and the sub bearing 132 will be described. In addition, one or more back pressure pockets 1315*a*, 1315*b*, 1325*a*, 1325*b* may be disposed in each of the main bearing 131 and the sub bearing 132, and according to one embodiment, an example in which two back pressure pockets are defined in each of the main bearing 131 and the sub bearing 132 will be described.

However, embodiments are not necessarily limited to this structure, and the back pressure pockets 1315*a*, 1315*b*, 1325*a*, 1325*b* may be provided only in the main bearing 131, and further, one or three of the back pressure pockets 1315*a*, 1315*b*, 1325*a*, 1325*b* may be defined in each of the main bearing 131 and the sub bearing 132.

The main bearing 131 may include main plate portion 1311 coupled to the cylinder 133 to cover an upper side of the cylinder 133. In addition, the sub bearing 132 may include sub plate portion 1321 coupled to the cylinder 133 to cover a lower side of the cylinder 133.

The back pressure pockets 1315*a*, 1315*b*, 1325*a*, 1325*b* may include first and second main back pressure pockets 1315*a*, 1315*b* spaced apart from each other at a predetermined distance from a lower surface of the main plate 1311 of the main bearing 131. In addition, the back pressure pockets 1315*a*, 1315*b*, 1325*a*, 1325*b* may further include first and second sub back pressure pockets 1325*a*, 1325*b* spaced apart from each other at a predetermined distance from an upper surface of the sub bearing 132.

A detailed configuration of the first and second main back pressure pockets 1315*a*, 1315*b* and the first and second sub back pressure pockets 1325*a*, 1325*b* will be described hereinafter.

The compression unit 130 may be configured to include the cylinder 133, the roller 134, the plurality of vanes 1351, 1352, 1353, the main bearing 131, and the sub bearing 132. The main bearing 131 and the sub bearing 132 may be provided at upper and lower sides of the cylinder 133, respectively, to constitute the compression space V together with the cylinder 133, the roller 134 may be rotatably provided in the compression space V, the vanes 1351, 1352, 1353 may be slidably inserted into the roller 134, the plurality of vanes 1351, 1352, 1353 respectively come into contact with the inner periphery of the cylinder 133, and the compression space V may be partitioned into a plurality of compression chambers.

Referring to FIGS. 1 to 3, the main bearing 131 may be fixedly provided at the intermediate shell 111 of the casing 110. For example, the main bearing 131 may be inserted into and welded to the intermediate shell 111.

The main bearing 131 may be closely coupled to an upper end of the cylinder 133. Accordingly, the main bearing 131 may define an upper surface of the compression space V, and support an upper surface of the roller 134 in the axial direction, and at the same time, support an upper half portion of the rotational shaft 123 in the radial direction.

The main bearing 131 may include the main plate portion 1311. The main plate portion 1311 may be coupled to the cylinder 133 to cover an upper side of the cylinder 133.

The main bearing 131 may further include the main bush portion 1312. The main bush portion 1312 may extend from a center of the main plate portion 1311 in the axial direction toward the drive motor 120 to support the upper half portion of the rotational shaft 123.

The main plate portion 1311 may be defined, for example, in a disk shape, and an outer peripheral surface of the main plate portion 1311 may be closely fixed to an inner peripheral surface of the intermediate shell 111. At least one discharge port 1313*a* may be disposed in the main plate portion 1311, a discharge valve 1361 that opens and closes the discharge port 1313*a* may be provided on an upper surface of the main plate portion 1311, and a discharge muffler 137 having a discharge space (no reference numeral) may be provided at an upper side of the main plate portion 1311 to accommodate the discharge port 1313*a* and the discharge valve 1361. The discharge port 1313*a* will be described hereinafter.

Although an example in which the discharge port 1313*a* is defined in two pairs is shown in FIG. 3, for example, embodiments may not be necessarily limited thereto, and may be defined in a plurality of pairs. For example, the discharge ports 1313*a* may be defined in three pairs.

As described above, the groove portion 1317, 1327 may be disposed in the main bearing 131 and the sub bearing 132 to be connected to the curved surface 1351*c*, 1351*d* of the vane 1351, 1352, 1353. The groove portion 1317, 1327 may be disposed in at least one of a lower surface of the main bearing 131 and an upper surface of the sub bearing 132 in contact with an upper surface of the vane 1351, 1352, 1353, and may be disposed to be spaced apart by a predetermined distance from an outer periphery of the main bearing 131 or the sub bearing 132.

Further, a plurality of the groove portion 1317, 1327 may be provided. The plurality of groove portions 1317, 1327 may be disposed to be spaced apart from one another by a predetermined distance along the circumferential direction.

Referring to FIGS. 4 and 5, an example is shown in which nine groove portions 1317, 1327 are disposed to be spaced apart from one another in the circumferential direction on the lower surface of the main bearing 131 and the upper surface of the sub bearing 132.

Figure 7:
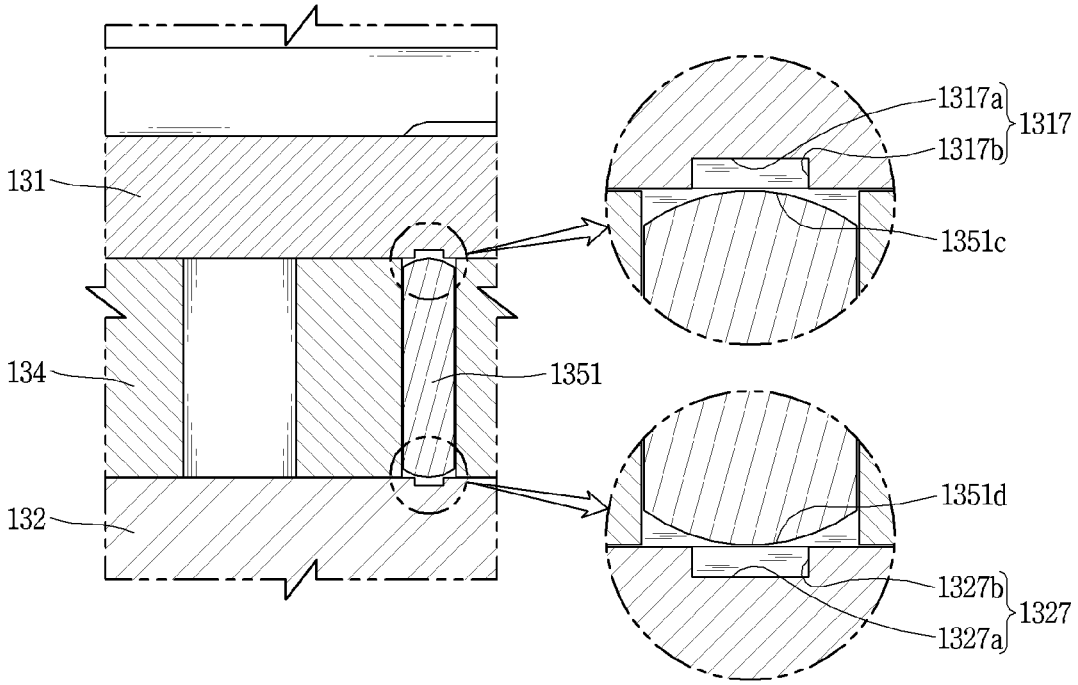
FIG. 7 is an enlarged cross-sectional view of a rotor, a vane, and a main/sub bearing according to an embodiment.

Referring to FIG. 7, structure of the groove portion 1317, 1327 according to embodiments will be described hereinafter.

Figure 8A:
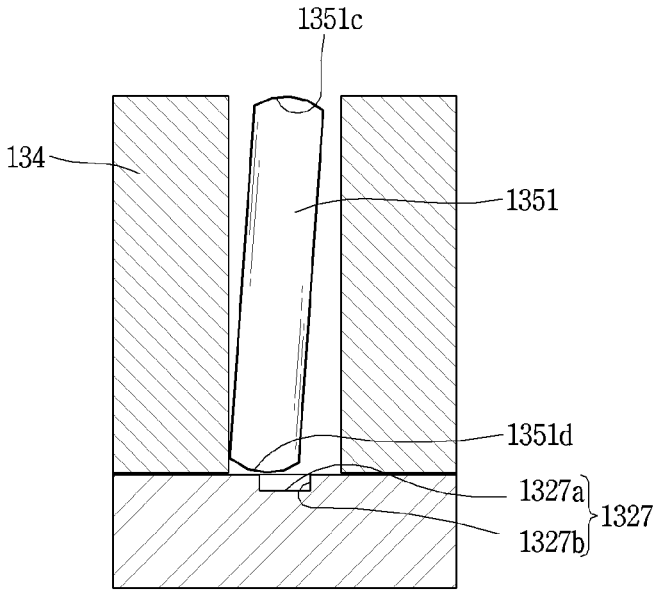
FIG. 8A is a cross-sectional view showing an example in which a vane is inclined inside a vane slot in suction and compression processes.
Figure 8B:
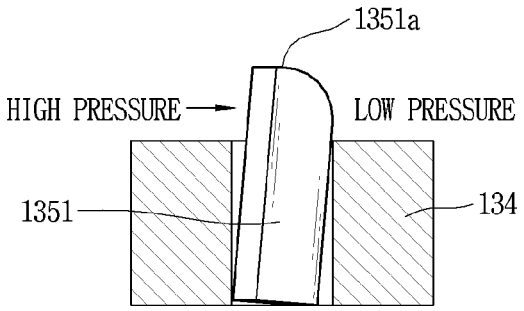
FIG. 8B is a cross-sectional view showing an example in which the vane protrudes toward an inner periphery of a cylinder in suction and compression processes.
Figure 9A:
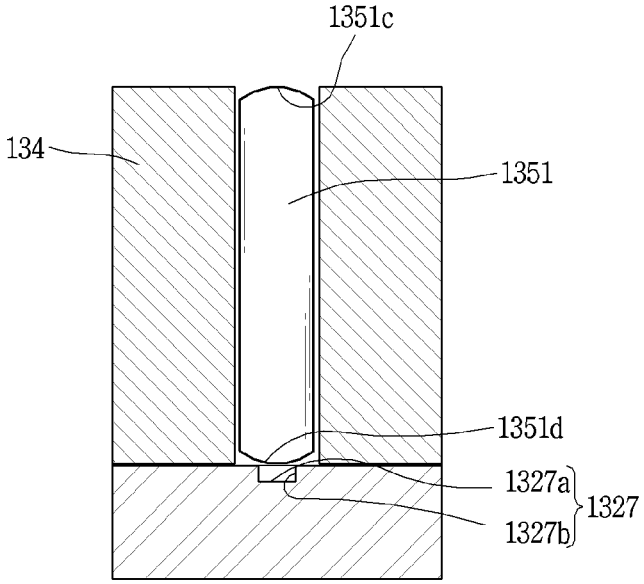
FIG. 9A is a cross-sectional view showing an example in which the vane is accommodated in the vane slot without being inclined in a discharge process.
Figure 9B:
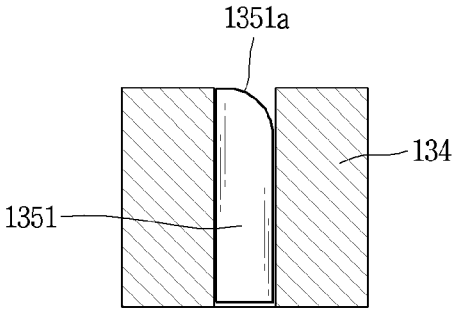
FIG. 9B is a cross-sectional view showing an example in which the vane is retracted in the discharge process.

FIG. 7 is an enlarged cross-sectional view of a roller, a vane, and a main/sub bearing according to an embodiment. FIG. 8A is a cross-sectional view showing an example in which the vane is inclined inside of the vane slot in suction and compression processes. FIG. 8B is a cross-sectional view showing an example in which the vane protrudes toward an inner periphery of the cylinder in the suction and compression processes. FIG. 9A is a cross-sectional view showing an example in which the vane is accommodated in the vane slot without being inclined in the discharge process, and FIG. 9B is a cross-sectional view showing an example in which the vane is retracted in the discharge process.

Referring to FIG. 7, an example is shown in which the groove portion 1317, 1327 is provided in the main bearing 131 in contact with one surface of the vane 1351, 1352, 1353 to be adjacent to an upper curved surface 1351*c*, 1351*d* of the vane 1351, 1352, 1353, and configured to include a first portion 1317*a* defined in parallel to an upper end of the cylinder 133 and a second portion 1317*b* defined to be connected to the first portion 1317*a* so as to intersect the first portion 1317*a* so as to define a lateral surface thereof. When the groove portion 1317, 1327 is a groove having a cylindrical shape, the second portion 1317*b* may extend in the circumferential direction. Further, for example, the first and second portions 1317*a*, 1317*b* may be orthogonal to each other.

In addition, in FIG. 7, an example is shown in which the groove portion 1317, 1327 is provided in the sub bearing 132 in contact with one surface of the vane 1351, 1352, 1353 to be adjacent to a lower curved surface 1351*c*, 1351*d* of the vane 1351, 1352, 1353, and configured to include a third portion 1327*a* defined in parallel to an upper end of the cylinder 133 and a fourth portion 1327*b* defined to be connected to the third portion 1327*a* so as to intersect the third portion 1327*a* so as to define a lateral surface thereof. When the groove portion 1317, 1327 is a groove having a cylindrical shape, the fourth portion 1327*b* may extend in the circumferential direction. Further, for example, the third and fourth portions 1327*a*, 1327*b* may be orthogonal to each other.

By defining the groove portion 1317, 1327 on an end surface of the main bearing 131 in contact with the vane 1351, 1352, 1353, some oil may be recovered from a portion between the vane 1351, 1352, 1353 and the vane slot 1342*a*, 1342*b*, 1342*c*, in which a hydraulic pressure increases, to reduce the hydraulic pressure, thereby improving an overall lubrication environment through the oil accumulated in the groove portion 1317, 1327. In addition, a friction area between the upper curved surface 1351*c*, 1351*d* of the vane 1351, 1352, 1353 and the end surface of the main bearing 131 may be reduced by defining the groove portion 1317, 1327 on the end surface of the main bearing 131, thereby reducing a hydraulic pressure rise that may be formed between the upper end of the vane 1351, 1352, 1353 and the main bearing 131 during the rotation of the vane.

Further, as the vane 1351, 1352, 1353 rotates, the groove portion 1317, 1327 may recover oil that accumulates in a portion of the main bearing 131 in contact with the upper end of the vane 1351, 1352, 1353 to rotate together therewith, thereby allowing the oil to be uniformly present as a whole. In addition, as the accumulated oil is accommodated in the sub bearing 132 provided at the lower end of the cylinder 133 while the main bearing 131 provided at the upper end of the cylinder 133 lacks an oil film, oil may be accommodated in the groove portion 1317, 1327 of the main bearing 131, thereby creating an improved lubrication environment than before.

On the other hand, referring to FIGS. 8A and 8B, when refrigerant is suctioned and compressed into the cylinder 133, the vane 1351, 1352, 1353 may protrude to an inner circumference of the cylinder from the compression space, and at this time, the vane 1351, 1352, 1353 may be inclined laterally inside of the vane slot 1342*a*, 1342*b*, 1342*c* by a differential pressure. However, at least one of upper and lower end surfaces of the vane 1351, 1352, 1353 may be defined as the curved surface 1351*c*, 1351*d*, and as a result, even though the vane 1351, 1352, 1353 is inclined from high pressure to low pressure, surface contact due to the curved surface 1351*c*, 1351*d* may be allowed while coming into contact with the main bearing 131 and the sub bearing 132, which will be described hereinafter, to increase leakage length, thereby preventing an oil film from being destroyed.

Further, even when an inclination direction of the vane 1351, 1352, 1353 is changed, a direction change may be naturally induced.

In FIGS. 9A and 9B, an example in which the vane 1351, 1352, 1353 is securely accommodated in the vane slot 1342*a*, 1342*b*, 1342*c* without being inclined in the discharge process, and an example in which the vane 1351, 1352, 1353 is retracted in the discharging process are shown. Referring to FIG. 5, first main back pressure pocket 1315*a* and second main back pressure pocket 1315*b* may be disposed on the lower surface of the main plate portion 1311 facing the upper surface of the roller 134 between axial side surfaces of the main plate portion 1311.

The first main back pressure pocket 1315*a* and the second main back pressure pocket 1315*b* may be defined, for example, in an arc shape and disposed at a predetermined interval along the circumferential direction. Inner peripheral surfaces of the first main back pressure pocket 1315*a* and the second main back pressure pocket 1315*b* may be defined, for example, in a circular shape, but outer peripheral surfaces thereof may be defined, for example, in an elliptical shape in consideration of the vane slots 1342*a*, 1342*b*, 1342*c* to be described later.

In addition, referring to FIGS. 5 and 7, an example of the first main back pressure pocket 1315*a* having a relatively wide width and the second main back pressure pocket 1315*b* having a relatively narrow width is shown, and an example in which both inner peripheral surfaces of the first and the second main back pressure pockets 1315*a*, 1315*b* are defined in a circular shape, and outer peripheral surfaces thereof are defined in an elliptical shape is shown; however, embodiments are not necessarily limited to this structure. In addition, for example, the first main back pressure pocket 1315*a* may accommodate high-pressure refrigerant to provide a high back pressure to the rear end surface 1351*b*, 1352*b*, 1353*b* of the vane 1351, 1352, 1353, and the second main back pressure pocket 1315*b* may accommodate intermediate-pressure refrigerant to provide an intermediate back pressure to the rear end surface 1351*b*, 1352*b*, 1353*b* of the vane 1351, 1352, 1353.

The first main back pressure pocket 1315*a* and the second main back pressure pocket 1315*b* may be defined within an outer diameter range of the roller 134. Accordingly, the first main back pressure pocket 1315*a* and the second main back pressure pocket 1315*b* may be separated from the compression space V.

The plurality of groove portions 1317, 1327 may be disposed along the circumferential direction to be spaced apart from outer peripheries of the first and second main back pressure pockets 1315*a*, 1315*b*.

In FIG. 5, an example in which the main bearing 131 includes the main plate portion 1311 in a disk shape is shown, an example in which the first and second main back pressure pockets 1315*a*, 1315*b* are spaced apart from each other at a predetermined interval and defined in a half-moon shape on a lower surface of the main plate portion 1311 is shown, and an example in which nine groove portions 1317, 1327 are disposed to be spaced apart from one another on outer peripheries of the first and second main back pressure pockets 1315*a*, 1315*b* is shown. By defining the groove portion 1317, 1327 on an end surface of the main bearing 131 in contact with the vane 1351, 1352, 1353, some oil is recovered from a portion between the vane 1351, 1352, 1353 and the vane slot 1342*a*, 1342*b*, 1342*c*, in which a hydraulic pressure increases, to reduce the hydraulic pressure, thereby improving an overall lubrication environment through the oil accumulated in the groove portion 1317, 1327.

In addition, a friction area between the lower curved surface 1351*c*, 1351*d* of the vane 1351, 1352, 1353 and the end surface of the main bearing 131 may be reduced by defining the groove portion 1317, 1327 on the end surface of the main bearing 131, thereby reducing a hydraulic pressure rise that may be formed between the lower end of the vane 1351, 1352, 1353 and the main bearing 131 during the 1351, 1352, 1353 of rotation of the vane 1351, 1352, 1353.

Further, as the vane 1351, 1352, 1353 rotates, the groove portion 1317, 1327 may recover oil that accumulates in a portion of the main bearing 131 in contact with the upper end of the vane 1351, 1352, 1353 to rotate together therewith, thereby allowing the oil to be uniformly present as a whole. In addition, unlike the sub bearing 132 in which the accumulated oil is accommodated, in the main bearing 131 lacking an oil film, oil may be accommodated in the groove portion 1317, 1327, thereby creating an improved lubrication environment than before.

A back pressure in the first main back pressure pocket 1315*a* may be greater than that in the second main back pressure pocket 1315*b*. That is, the first main back pressure pocket 1315*a* may be provided in the vicinity of the discharge port 1313*a* to provide a discharge back pressure. Further, the second main back pressure pocket 1315*b* may define an intermediate pressure between the suction pressure and the discharge pressure.

In the first main back pressure pocket 1315*a*, oil (refrigerant oil) may pass through a fine passage between a first main bearing protrusion 1316*a* and an upper surface 134*a* of the roller 134, which will be described hereinafter, to flow into the first main back pressure pocket 1315*a*. The second main back pressure pocket 1315*b* may be defined within a range of the compression chamber defining an intermediate pressure in the compression space V. Accordingly, the second main back pressure pocket 1315*b* maintains an intermediate pressure.

The second main back pressure pocket 1315*b* defines an intermediate pressure which is a pressure lower than that of the first main back pressure pocket 1315*a*. In the second main back pressure pocket 1315*b*, oil flowing into the main bearing hole 1312*a* of the main bearing 131 through the first oil through hole 126*a* may flow into the second main back pressure pocket 1315*b*. The second main back pressure pocket 1315*b* may be defined within a range of the compression chamber V2 defining a suction pressure in the compression space V. Accordingly, the second main back pressure pocket 1315*b* maintains the suction pressure.

In addition, on inner peripheral sides of the first main back pressure pocket 1315*a* and the second main back pressure pocket 1315*b*, respectively, the first main bearing protrusion 1316*a* and the second main bearing protrusion 1316*b* may be disposed to extend from the main bearing surface 1312*b* of the main bush portion 1312. Accordingly, the first main back pressure pocket 1315*a* and the second main back pressure pocket 1315*b* may be sealed to the outside, and at the same time, the rotational shaft 123 may be stably supported.

The first main bearing protrusion 1316*a* and the second main bearing protrusion 1316*b* may be disposed at a same height, and an oil communication groove (not shown) or an oil communication hole (not shown) may be disposed on an inner peripheral end surface of the second main bearing protrusion 1316*b*. Alternatively, an inner peripheral height of the second main bearing protrusion 1316*b* may be disposed to be lower than that of the first main bearing protrusion 1316*a*. Accordingly, high-pressure oil (refrigerant oil) flowing into the main bearing surface 1312*b* may flow into the first main back pressure pocket 1315*a*. The first main back pressure pocket 1315*a* defines a higher pressure (discharge pressure) than the second main back pressure pocket 1315*b*.

The main bush portion 1312 may be disposed in a hollow bush shape, and a first oil groove 1312*c* may be disposed on an inner peripheral surface of the main bearing hole 1312*a* constituting an inner peripheral surface of the main bush portion 1312. The first oil groove 1312*c* may be defined, for example, in an oblique or spiral shape between upper and lower ends of the main bush portion 1312 such that the lower end thereof communicates with the first oil through hole 126*a*. In FIG. 4, an example is shown in which the main bush portion 1312 is defined in an upward direction in a hollow bush shape on the main plate 1311, and the oil groove 1312*c* is defined in an oblique direction on an inner peripheral surface of the main bearing hole 1312*a* constituting an inner peripheral surface of the main bush portion 1312.

Although not shown in the drawings, an oil groove may be defined in a diagonal or spiral shape on an outer peripheral surface of the rotational shaft 123, that is, an outer peripheral surface of the main bearing portion 123*b*.

Referring to FIGS. 1 and 2, the sub bearing 132 may be closely coupled to a lower end of the cylinder 133. Accordingly, the sub bearing 132 defines a lower surface of the compression space V, and supports the lower surface of the roller 134 in the axial direction, and at the same time supports a lower half portion of the rotational shaft 123 in the radial direction.

Referring to FIGS. 2 and 4, the sub bearing 132 may include the sub plate portion 1321. The sub plate portion 1321 may be coupled to the cylinder 133 to cover a lower side of the cylinder 133.

In addition, the sub bearing 132 may further include the sub bush portion 1322. The sub bush portion 1322 may extend from a center of the sub plate portion 1321 in the axial direction toward the lower shell 112 to support the lower half portion of the rotational shaft 123.

The sub plate portion 1321 may be defined, for example, in a disk shape similar to that of the main plate portion 1311. An outer peripheral surface of the sub plate portion 1321 may be spaced apart from an inner peripheral surface of the intermediate shell 111.

A first sub back pressure pocket 1325*a* and a second sub back pressure pocket 1325*b* may be disposed on an upper surface of the sub plate portion 1321 facing a lower surface of the roller 134 between axial side surfaces of the sub plate portion 1321. The first sub back pressure pocket 1325*a* and the second sub back pressure pocket 1325*b* may be disposed to be symmetrical with respect to the first main back pressure pocket 1315*a* and the second main back pressure pocket 1315*b*, respectively, described above around the roller 134.

Referring to FIGS. 4 and 5, an example of the first sub back pressure pocket 1325*a* having a relatively wide width and the second sub back pressure pocket 1325*b* having a relatively narrow width is shown, and an example in which both inner peripheral surfaces of the first and the second sub back pressure pockets 1325*a*, 1325*b* are defined in a circular shape, and outer peripheral surfaces thereof are defined in an elliptical shape is shown; however, embodiments are not necessarily limited to this structure.

In addition, for example, the first sub back pressure pocket 1325*a* may accommodate high-pressure refrigerant to provide a high back pressure to the rear end surface 1351*b*, 1352*b*, 1353*b* of the vane 1351, 1352, 1353, and the second sub back pressure pocket 1325*b* may accommodate intermediate-pressure refrigerant to provide an intermediate back pressure to the rear end surface 1351*b*, 1352*b*, 1353*b* of the vane 1351, 1352, 1353. Further, the first and second sub back pressure pockets 1325*a*, 1325*b* may be defined in a shape corresponding to the first and second main back pressure pockets 1315*a*, 1315*b*, respectively.

For example, the first sub back pressure pocket 1325*a* may be disposed to be symmetrical with respect to the first main back pressure pocket 1315*a* with the roller 134 interposed therebetween, and the second sub back pressure pocket 1325*b* to be symmetrical with respect to the second main back pressure pocket 1315*b* with the roller 134 interposed therebetween. In addition, the plurality of groove portions 1317, 1327 may be disposed along the circumferential direction to be spaced apart from the outer peripheries of the first sub back pressure pocket 1325*a* and the second sub back pressure pocket.

In FIG. 4, an example including the sub plate portion 1321 in a disk shape is shown, an example in which the first and second sub back pressure pockets 1325*a*, 1325*b* are spaced apart from each other and defined in a half-moon shape on an upper surface of the sub plate portion 1321 is shown, and an example in which nine groove portions 1317, 1327 are disposed to be spaced apart from one another on outer peripheries of the first and second sub back pressure pockets 1325*a*, 1325*b* is shown. By defining the groove portion 1317, 1327 on an end surface of the sub bearing 132 in contact with the vane 1351, 1352, 1353, some oil is recovered from a portion between the vane 1351, 1352, 1353 and the vane slot 1342*a*, 1342*b*, 1342*c*, in which a hydraulic pressure increases, to reduce the hydraulic pressure, thereby improving an overall lubrication environment through the oil accumulated in the groove portion 1317, 1327.

In addition, a friction area between the lower curved surface 1351*c*, 1351*d* of the vane 1351, 1352, 1353 and the end surface of the sub bearing 132 may be reduced by defining the groove portion 1317, 1327 on the end surface of the sub bearing 132, thereby reducing a hydraulic pressure rise that may be formed between the lower end of the vane 1351, 1352, 1353 and the sub bearing 132 during the rotation of the vane. Further, as the vane 1351, 1352, 1353 rotates, the groove portion 1317, 1327 may recover oil that accumulates in a portion of the sub bearing 132 in contact with the lower end of the vane 1351, 1352, 1353 to rotate together therewith, thereby allowing the oil to be uniformly present as a whole.

A first sub bearing protrusion 1326*a* may be disposed on an inner peripheral side of the first sub back pressure pocket 1325*a*, and a second sub bearing protrusion 1326*b* may be disposed on an inner peripheral side of the second sub back pressure pocket 1325*b*, respectively. However, in some cases, the first sub back pressure pocket 1325*a* and the second sub back pressure pocket 1325*b* may be disposed to be asymmetrical with respect to the first main back pressure pocket 1315*a* and the second main back pressure pocket 1315*b*, respectively, around the roller 134. For example, the first sub back pressure pocket 1325*a* and the second sub back pressure pocket 1325*b* may be disposed to have different depths from those of the first main back pressure pocket 1315*a* and the second main back pressure pocket 1315*b*. In addition, an oil supply hole (not shown) may be disposed between the first sub back pressure pocket 1325*a* and the second sub back pressure pocket 1325*b*, precisely, between the first sub bearing protrusion 1326*a* and the second sub bearing protrusion 1326*b* or at a portion where the first sub bearing protrusion 1326*a* and the second sub bearing protrusion 1326*b* are connected to each other.

For example, a first end constituting an inlet of the oil supply hole (not shown) may be disposed to be submerged in the oil storage space 110*b*, and a second end constituting an outlet of the oil supply hole may be disposed to be positioned on a rotational path of the back pressure chambers 1343*a*, 1343*b*, 1343*c* on an upper surface of the sub plate portion 1321 facing a lower surface of the roller 134 described hereinafter. Accordingly, during rotation of the roller 134, high-pressure oil stored in the oil storage space 110*b* may be periodically supplied to the back pressure chambers 1343*a*, 1343*b*, 1343*c* through the oil supply hole (not shown) while the back pressure chambers 1343*a*, 1343*b*, 1343*c* periodically communicate with the oil supply hole (not shown), and through this, each of the vanes 1351, 1352, 1353 may be stably supported toward the inner peripheral surface 1332 of the cylinder 133.

The sub bush portion 1322 may be formed in a hollow bush shape, and a second oil groove 1322*c* may be disposed on an inner peripheral surface of a hole 1322*a* of the sub bearing 132 constituting an inner peripheral surface of the sub bush portion 1322. The second oil groove 1322*c* may be defined in a straight line or an oblique line between upper and lower ends of the sub bush portion 1322 such that an upper end thereof communicates with the second oil through hole 126*b* of the rotational shaft 123.

Although not shown in the drawings, an oil groove may be defined in a diagonal or spiral shape on an outer peripheral surface of the rotational shaft 123, that is, an outer peripheral surface of a sub bearing portion 123*c*. In addition, although not shown in the drawings, the back pressure pockets 1315*a*, 1315*b*, 1325*a*, 1325*b* may be disposed in only one of the main bearing 131 and the sub bearing 132.

The discharge ports 1313*a* may be disposed in the main bearing 131 as described above. However, the discharge port 1313*a* may be disposed in the sub bearing 132 or may be disposed in the main bearing 131 and the sub bearing 132, respectively, and disposed to pass through between inner and outer peripheral surfaces of the cylinder 133. This embodiment will be mainly described as an example in which the discharge port 1313*a* is disposed in the main bearing 131.

Only one pair of discharge ports 1313*a* may be disposed, or three pairs of outlets 1313*a* may be disposed as described above. Although not shown in this embodiment, a plurality of pairs of the discharge ports 1313*a* may be disposed at a predetermined interval along a compression advancing direction (or a rotational direction of the roller 134, a clockwise direction indicated by an arrow on the roller 134 in FIG. 3).

Referring to FIGS. 3 and 5, an example is shown in which one pair of two discharge ports 1313*a* in total are disposed to pass through the main bearing 131. In general, in the vane 1351, 1352, 1353 type rotary compressor 100, as the roller 134 is disposed eccentrically with respect to the compression space V, a proximal point P1 almost in contact between an outer peripheral surface 1341 of the roller 134 and an inner peripheral surface 1332 of the cylinder 133 is generated, and the discharge port 1313 is disposed in the vicinity of the proximal point P1. Accordingly, as the compression space V approaches the proximal point P1, a distance between the inner peripheral surface 1332 of the cylinder 133 and the outer peripheral surface 1341 of the roller 134 is greatly decreased, thereby making it difficult to secure an area for the discharge port 1313*a*.

Accordingly, although not shown in the drawing, in the case of one or more pairs of discharge ports 1313*a*, the discharge port 1313*a* may be divided into a plurality of discharge ports 1313*a* as in the this embodiment to be defined along a rotational direction (or compression advancing direction) of the roller 134. Further, the plurality of discharge port 1313*a* may be respectively defined one by one, but may be defined in pairs as in this embodiment.

However, unlike this embodiment, when the vane slots 1342*a*, 1342*b*, 1342*c* are disposed at unequal intervals, a circumferential length of each compression chamber V1, V2, V3 may be defined to be different. When a plurality of pairs of discharge ports 1313*a* are disposed, a plurality of discharge ports 1313*a* may communicate with one compression chamber, or a plurality of compression chambers may communicate with one discharge port 1313*a*.

In addition, referring to FIG. 3, a discharge groove 1314 may be disposed to extend to the discharge port 1313*a* according to this embodiment. The discharge groove 1314 may extend, for example, in an arc shape along a compression advancing direction (rotational direction of the roller 134). Accordingly, refrigerant that is not discharged from a preceding compression chamber may be guided to the discharge port 1313*a* communicating with a subsequent compression chamber through the discharge groove 1314 to be discharged together with the refrigerant compressed in the subsequent compression chamber. Through this, residual refrigerant in the compression space V may be minimized to suppress over-compression, thereby improving compressor efficiency.

The discharge groove 1314 as described above may be disposed to extend from the discharge port 1313*a*. In general, in the vane 1351, 1352, 1353 type rotary compressor 100, the compression space V may be partitioned into a suction chamber and a discharge chamber at both sides with the proximal portion (proximal point) 1332*a* interposed therebetween, the discharge port 1313*a* is unable to overlap the proximal point P1 positioned in the proximal portion 1332*a* in consideration of sealing between the suction chamber and discharge chamber. Accordingly, between the proximal point P1 and the discharge ports 1313*a*, a residual space spaced apart between the inner peripheral surface 1332 of the cylinder 133 and the outer peripheral surface 1341 of the roller 134 is defined along the circumferential direction, refrigerant remains in this residual space without being discharged through the discharge port 1313*a*. The residual refrigerant may increase a pressure of the compression chamber to cause a decrease in compression efficiency due to over-compression.

However, as in this embodiment, when the discharge groove 1314 extends from the discharge port 1313*a* to the remaining space, refrigerant remaining in the residual space may flow back to the discharge port 1313*a* through the discharge groove 1314 to be additionally discharged, thereby effectively suppressing a decrease in compression efficiency due to over-compression in the compression chamber.

Although not shown in the drawings, a residual discharge hole may be disposed in a residual space in addition to the discharge groove 1314. The residual discharge hole may be disposed to have a smaller inner diameter compared to the discharge port 1313*a*, and unlike the discharge port 1313*a*, the residual discharge hole may be always open without being opened or closed by the discharge valve.

Further, the discharge port 1313*a* may be opened and closed by the discharge valve 1361 described above. The discharge valve 1361 may be configured with a cantilevered reed valve having one end constituting a fixed end and the other end constituting a free end. As such a discharge valve 1361 is widely known in the rotary compressor 100 in the related art, detailed description thereof has been omitted.

Referring to FIGS. 1 to 3, the cylinder 133 according to this embodiment may be in close contact with the lower surface of the main bearing 131 and bolt-fastened to the main bearing 131 together with the sub bearing 132. As described above, as the main bearing 131 is fixedly coupled to the casing 110, the cylinder 133 may be fixedly coupled to the casing 110 by the main bearing 131.

The cylinder 133 may be defined in an annular shape having an empty space portion to form the compression space V in the center. The empty space portion may be sealed by the main bearing 131 and the sub bearing 132 to form the above-described compression space V, and the roller 134 may be rotatably coupled to the compression space V.

Referring to FIGS. 1 and 2, the cylinder 133 may be defined such that the suction port 1331 passes through inner and outer peripheral surfaces thereof. However, unlike FIG. 2, the suction port 1331 may be disposed to pass through inner and outer peripheral surfaces of the main bearing 131 or the sub bearing 132.

The suction port 1331 may be disposed at one side in the circumferential direction around the proximal point P1 described hereinafter. The discharge port 1313*a* described above may be disposed in the main bearing 131 at the other side in the circumferential direction opposite to the suction port 1331 around the proximal point P1.

The inner peripheral surface 1332 of the cylinder 133 may be defined, for example, in an elliptical shape. The inner peripheral surface 1332 of the cylinder 133 according to this embodiment may be defined, for example, in an asymmetric elliptical shape by combining a plurality of ellipses, for example, four ellipses having different major and minor ratios to have two origins.

More specifically, the inner peripheral surface 1332 of the cylinder 133 according to this embodiment may be defined to have a first origin Or, which is a rotational center of the roller 134 (an axial center or an outer diameter center of the cylinder 133), and a second origin O' that is biased toward a distal portion 1332*b* with respect to the first origin Or. The X-Y plane defined around the first origin Or defines third and fourth quadrants, and the X-Y plane defined around the second origin O' defines first and second quadrants. The third quadrant is defined by the third ellipse, the fourth quadrant by the fourth ellipse, respectively, and the first quadrant may be defined by the first ellipse, and the second quadrant by the second ellipse, respectively.

In addition, the inner peripheral surface 1332 of the cylinder 133 according to this embodiment may include a proximal portion 1332*a*, a distal portion 1332*b*, and a curved portion 1332*c*. The proximal portion 1332*a* is a portion closest to an outer peripheral surface of the roller 134 (or the rotational center Or of the roller 134), the distal portion 1332*b* is a portion farthest from the outer peripheral surface 1341 of the roller 134, and the curved portion 1332*c* is a portion connecting the proximal portion 1332*a* and the distal portion 1332*b*.

Referring to FIGS. 3 and 4, the roller 134 may be rotatably provided in the compression space V of the cylinder 133, and the plurality of vanes 1351, 1352, 1353 may be inserted at a predetermined interval into the roller 134 along the circumferential direction. Accordingly, compression chambers as many as the number of the plurality of vanes 1351, 1352, 1353 may be partitioned and defined in the compression space V. In this embodiment, an example will be mainly described in which the plurality of vanes 1351, 1352, 1353 are made up of three and the compression space V are partitioned into three compression chambers.

The roller 134 according to this embodiment has outer peripheral surface 1341 defined in a circular shape, and the rotational shaft 123 may be extended as a single body or may be post-assembled and combined therewith at the rotational center Or of the roller 134. Accordingly, the rotational center Or of the roller 134 is coaxially positioned with respect to an axial center (unsigned) of the rotational shaft 123, and the roller 134 rotates concentrically together with the rotational shaft 123.

However, as described above, as the inner peripheral surface 1332 of the cylinder 133 is defined in an asymmetric elliptical shape biased in a specific direction, the rotational center Or of the roller 134 may be eccentrically disposed with respect to an outer diameter center Oc of the cylinder 133. Accordingly, in the roller 134, one side of the outer peripheral surface 1341 is almost in contact with the inner peripheral surface 1332 of the cylinder 133, precisely, the proximal portion 1332*a* to define the proximal point P1.

The proximal point P1 may be defined in the proximal portion 1332*a* as described above. Accordingly, an imaginary line passing through the proximal point P1 may correspond to a major axis of an elliptical curve defining the inner peripheral surface 1332 of the cylinder 133. In addition, the roller 134 may have a plurality of vane slots 1342*a*, 1342*b*, 1342*c* disposed to be spaced apart from one another along the circumferential direction on the outer peripheral surface 1341 thereof, and the plurality of vanes 1351, 1352, 1353 described hereinafter may be slidably inserted into and coupled to the vane slots 1342*a*, 1342*b*, 1342*c*, respectively.

Referring to FIG. 4, in the plurality of vane slots 1342*a*, 1342*b*, 1342*c*, a first vane slot 1342*a*, second vane slot 1342*b*, and third vane slot 1342*c* are shown along the compression advancing direction (the rotational direction of the roller 134, indicated by a clockwise arrow on the roller 134 in FIG. 3). The first vane slot 1342*a*, the second vane slot 1342*b*, and the third vane slot 1342*c* may be defined to have a same width and depth as one another at equal or unequal intervals along the circumferential direction, and an example is shown in which they are disposed to be spaced apart at equal intervals.

For example, the plurality of vane slots 1342*a*, 1342*b*, 1342*c* may be respectively disposed to be inclined by a predetermined angle with respect to the radial direction so as to sufficiently secure lengths of the vanes 1351, 1352, 1353. Accordingly, when the inner peripheral surface 1332 of the cylinder 133 is defined in an asymmetric elliptical shape, even though a distance from the outer peripheral surface 1341 of the roller 134 to the inner peripheral surface 1332 of the cylinder 133 increases, the vanes 1351, 1352, 1353 may be suppressed from being released from the vane slots 1342*a*, 1342*b*, 1342*c*, thereby increasing a degree of freedom in designing the inner peripheral surface 1332 of the cylinder 133.

Allowing a direction in which the vane slot 1342*a*, 1342*b*, 1342*c* is inclined to be an opposite direction to the rotational direction of the roller 134, that is, allowing the front end surface 1351*a*, 1352*a*, 1353*a* of each vane 1351, 1352, 1353 in contact with the inner peripheral surface 1332 of the cylinder 133 to be inclined toward the rotational direction of the roller 134 may be advantageous because a compression start angle may be pulled toward the rotational direction of the roller 134 to quickly start compression.

The back pressure chambers 1343*a*, 1343*b*, 1343*c* may be disposed to communicate with one another at inner ends of the vane slots 1342*a*, 1342*b*, 1342*c*. The back pressure chamber 1343*a*, 1343*b*, 1343*c* is a space in which refrigerant (oil) at a discharge pressure or intermediate pressure is accommodated toward a rear side of each vane 1351, 1352, 1353, that is, the rear end surface 1351*b*, 1352*b*, 1353*b* of the vane 1351, 1352, 1353, and each vane 1351, 1352, 1353 may be pressurized toward an inner peripheral surface of the cylinder 133 by a pressure of the refrigerant (or oil) filled in the back pressure chamber 1343*a*, 1343*b*, 1343*c*. For convenience, hereinafter, a direction toward the cylinder 133 with respect to a movement direction of the vane 1351, 1352, 1353 is defined as a front side, and an opposite side thereto as a rear side.

The back pressure chamber 1343*a*, 1343*b*, 1343*c* may be disposed to be sealed by the main bearing 131 and the sub bearing 132 at upper and lower ends thereof, respectively. The back pressure chambers 1343*a*, 1343*b*, 1343*c* may communicate independently with respect to each of the back pressure pockets 1315*a*, 1315*b*, 1325*a*, 1325, and may be disposed to communicate with one another by the back pressure pockets 1315*a*, 1315*b*, 1325*a*, 1325*b*.

In addition, as described above, at least a portion of the back pressure chambers 1343*a*, 1343*b*, 1343*c* may be defined as an arc surface, and a diameter of the arc surface of the back pressure chambers 1343*a*, 1343*b*, 1343*c* may be smaller than a distance between the first and second main back pressure pockets 1315*a*, 1315*b*. Due to this, when communicating with the first main back pressure pocket 1315*a* at high pressure by a discharge back pressure to receive the discharge back pressure while at the same time communicating with the second main back pressure pocket 1315*b*, an intermediate pressure of the second main back pressure pocket 1315*b* may be received as well to prevent a back pressure at the rear end surface 1351*b*, 1352*b*, 1353*b* of the vanes 1351, 1352, 1353 from being excessively increased.

In FIGS. 3 and 7, an example is shown in which the back pressure chamber 1343*a*, 1343*b*, 1343*c* is connected to the vane slot 1342*a*, 1342*b*, 1342*c* while having an arc surface, and a diameter of the arc surface of the back pressure chamber 1343*a*, 1343*b*, 1343*c* is made smaller than a distance between the first and second main back pressure pockets 1315*a*, 1315*b*. Referring to FIGS. 3 and 4, the plurality of vanes 1351, 1352, 1353 according to this embodiment may be slidably inserted into the vane slots 1342*a*, 1342*b*, 1342*c*, respectively. Accordingly, the plurality of vanes 1351, 1352, 1353 may be defined to have substantially the same shape as the vane slots 1342*a*, 1342*b*, 1342*c*, respectively.

For example, the plurality of vanes 1351, 1352, 1353 may be defined as first vane 1351, second vane 1352, and third vane 1353 along the rotational direction of the roller 134, and the first vane 1351 may be inserted into the first vane slot 1342*a*, the second vane 1352 into the second vane slot 1342*b*, and the third vane 1353 into the third vane slot 1342*c*, respectively, and such a configuration is shown in FIGS. 3 and 4. The plurality of vanes 1351, 1352, and 1353 may all have the same shape. More specifically, each of the plurality of vanes 1351, 1352, 1353 may be defined as a substantially rectangular parallelepiped, the front end surface 1351*a*, 1352*a*, 1353*a* in contact with the inner peripheral surface 1332 of the cylinder 133 may be defined as the curved surface 1351*c*, 1351*d*, and the rear end surface 1351*b*, 1352*b*, 1353*b* facing the respective back pressure chamber 1343*a*, 1343*b*, 1343*c* may be defined as a straight surface.

In addition, as described above, one surface in the plurality of vanes 1351, 1352, 1353 in contact with the main bearing 131 and the sub bearing 132 may be defined as the curved surface 1351*c*, 1351*d* having a predetermined curvature. For example, at least one of upper and lower surfaces of the plurality of vanes 1351, 1352, 1353 may be defined as the curved surface 1351*c*, 1351*d* having a predetermined curvature.

In FIGS. 7 and 8A, for example, an example is shown in which both upper and lower surfaces of the plurality of vanes 1351, 1352, 1353 are defined as the curved surface 1351*c*, 1351*d*. In this way, as at least one of the upper and lower surfaces of the plurality of vanes 1351, 1352, 1353 is defined as the curved surface 1351*c*, 1351*d*, surface contact with the main/sub bearing 131, 132 may be allowed to increase leakage length, thereby preventing an oil film from being broken. Further, even when an inclination direction of the vane 1351, 1352, 1353 is changed, a direction change may be naturally induced.

Figure 10A:
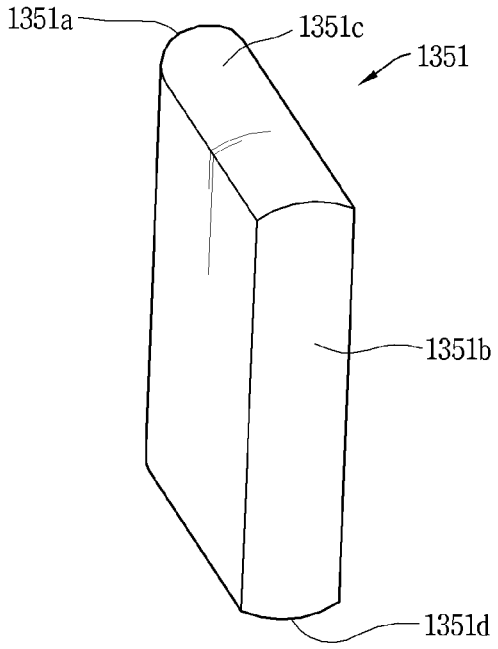
FIG. 10A is a perspective view of the vane according to an embodiment.
Figure 10B:
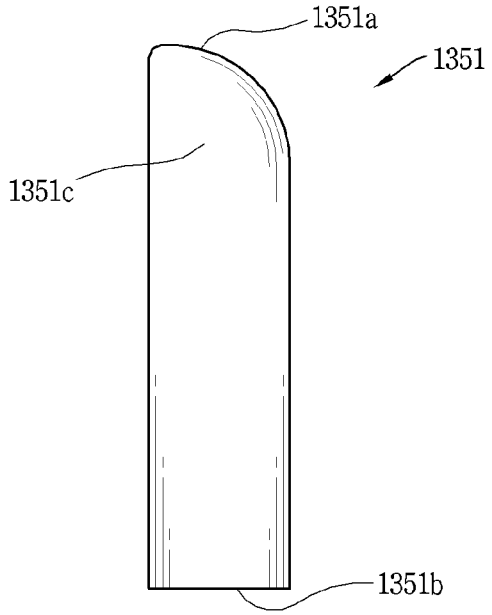
FIG. 10B is a plan view of the vane according to an embodiment.
Figure 10C:
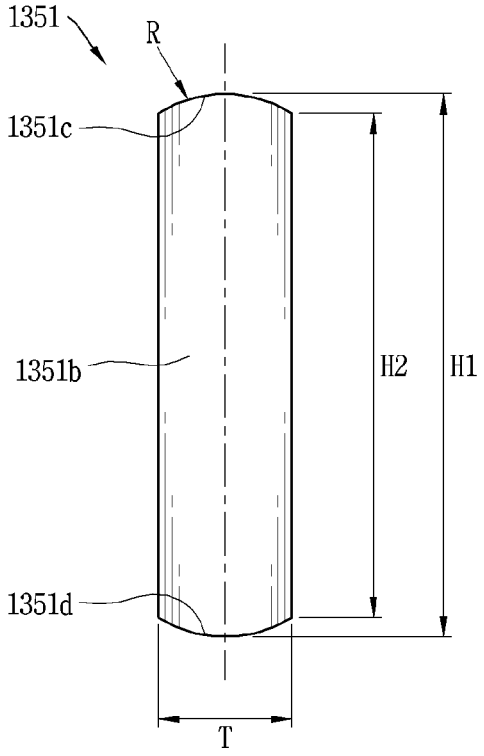
FIG. 10C is a longitudinal cross-sectional view of the vane according to an embodiment.
Figure 12:
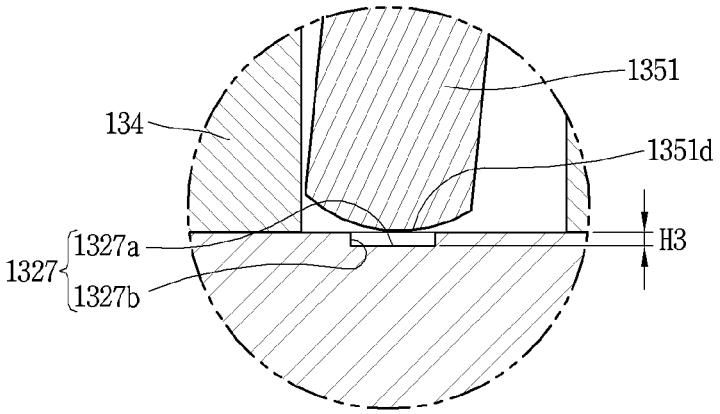
FIG. 12 is a cross-sectional view showing a lower end of the vane inclined inside of the vane slot in the suction and compression processes.

FIG. 10A is a perspective view of the vane according to an embodiment. FIG. 10B is a plan view of the vane according to an embodiment. FIG. 10C is a longitudinal cross-sectional view of the vane according to an embodiment. In addition, FIG. 11 is a plan view showing an example in which a groove portion is disposed in a leakage preventing region in FIG. 10, and FIG. 12 is a cross-sectional view showing a lower end of the vane inclined inside of the vane slot in the suction and compression processes.

Referring to FIGS. 10A and 10B, an example is shown in which the vane 1351, 1352, 1353 is drawn out from the roller 134 to have a front end surface in contact with the inner periphery of the cylinder 133, rear end surface 1351*b*, 1352*b*, 1353*b* disposed on an opposite side to the front end surface, and curved surface 1351*c*, 1351*d* of upper and lower ends thereof having predetermined curvatures. Further, as described above, on the curved surface 1351*c*, 1351*d* of the vane 1351, 1352, 1353, a distance from both sides where a curvature starts to a tangent to the curvature may be greater than an assembly tolerance between a surface of the vane 1351, 1352, 1353 and the main bearing 131 and the sub bearing 132, but less than or equal to 0.2 mm.

Referring to FIG. 10C, an example is shown in which on both sides of the vane 1351, 1352, 1353, a vertical distance between points where a curvature starts on the curved surface 1351*c*, 1351*d* of the vane 1351, 1352, 1353 is H2, and a distance between upper and lower ends of the curved surface 1351*c*, 1351*d* of the vane 1351, 1352, 1353 is H1. In this embodiment, "a distance from both sides where a curvature starts to a tangent to the curvature on the curved surface 1351*c*, 1351*d* of the vane 1351, 1352, 1353" refers to a distance from the uppermost point of H2 to the top point of H1 in FIG. 10C. When the "distance from both sides where a curvature starts to a tangent to the curvature on the curved surface 1351*c*, 1351*d* of the vane 1351, 1352, 1353" is smaller than an assembly tolerance, lubricating properties may be reduced.

That is, for example, the assembly tolerance may be 20 μm, and with respect to when the vanes 1351, 1352, 1353 are inclined, lubricating properties may be improved in consideration of a height difference between a height tolerance of the vane 1351, 1352, 1353 and a height at which a curvature is defined. In addition, when the "distance from both sides of the curvature starting point to the tangent of the curvature on the curved surfaces 1351*c* and 1351*d* of the vanes 1351, 1352, 1353" is greater than 2 mm, interference may occur during assembly, or damage may occur during operation. That is, when a height of the defined curvature is greater than 2 mm, the leakage distance is shortened and a size of the leakage communication path is increased, which may cause problems.

In FIG. 10C, as a distance between an upper portion of H1 and an upper portion of H2 increases, an amount of leakage of refrigerant, for example, decreases.

FIG. 11 shows an example in which the groove portions 1317, 1327 are disposed in a leakage preventing region. The leakage preventing region is a region disposed in contact between the main bearing 131 and the sub bearing 132, and the roller 134 for the leakage of refrigerant in the compression space. As described above, the plurality of groove portions 1317, 1327 may be disposed to be spaced apart along the circumferential direction, and may be disposed in the leakage preventing region as shown in FIG. 11.

The leakage preventing region may be disposed within a predetermined range of the roller 134 in consideration of the leakage of oil, for example, and is represented by a dotted line in FIG. 11.

When the plurality of groove portions 1317, 1327 is disposed in the leakage preventing region and the vane 1351, 1352, 1353 rotates together with the roller 134, some oil is recovered from a portion between the vane 1351, 1352, 1353 and the vane slot 1342*a*, 1342*b*, 1342*c*, in which a hydraulic pressure increases, to reduce the hydraulic pressure, thereby improving an overall lubrication environment through the oil accumulated in the groove portions 1317, 1327.

On the other hand, FIG. 12 shows a lower end of the vane 1351, 1352, 1353 inclined inside of the vane slot 1342*a*, 1342*b*, 1342*c* during the suction and compression processes. In FIG. 12, a depth of the groove portions 1317, 1327 is indicated by H3, and as described above, the depth of the groove portion 1317, 1327 may be greater than 0.1 mm but less than or equal to 5 mm.

As the depth of the groove portion 1317, 1327 has a depth greater than 0.1 mm but less than or equal to 5 mm, distribution of oil may be made uniform. If the depth of the groove portion 1317, 1327 is 0.1 mm or less, the volume becomes small, and the oil distribution cannot be made uniform due to a low oil tolerance. In addition, if the depth of the groove portion 1317, 1327 is 5 mm or more, oil cannot be filled in the groove portion 1317, 1327 because the amount of oil in the vane is less than this, and therefore, the groove portion 1317, 1327 may act as a dead volume, thereby causing leakage.

As described above, the depth of the groove portion 1317, 1327 must be greater than 0.1 mm but less than or equal to 5 mm. However, the depth of the groove portion 1317, 1327 may be greater than 0.5 mm and less than or equal to 1 mm.

The depth of the groove portion 1317, 1327 may be a value of (0.5 to 1% of a volume (cm^3) of compression chamber)/(π*(a diameter of the groove portion 1317, 1327 (cm)/2)^2).

In the rotary compressor 100 according to embodiments disclosed herein, when power is applied to the drive motor 120, the rotor 122 of the drive motor 120 and the rotational shaft 123 coupled to the rotor 122 rotate, and the roller 134 coupled to or integrally formed with the rotational shaft 123 rotates together with the rotational shaft 123. Then, the plurality of vanes 1351, 1352, 1353 is drawn out from the respective vane slots 1342*a*, 1342*b*, 1342*c* by a centrifugal force generated by rotation of the roller 134 and a back pressure of the back pressure chamber 1343*a*, 1343*b*, 1343*c* supporting the rear end surface 1351*b*, 1352*b*, 1353*b* of the vane 1351, 1352, 1353 to come into contact with the inner peripheral surface 1332 of the cylinder 133.

Then, the compression space V of the cylinder 133 is partitioned into compression chambers (including suction chambers or discharge chambers) V1, V2, V3 as many as the number of the plurality of vanes 1351, 1352, 1353 by the plurality of vanes 1351, 1352, 1353, a volume of the respective compression chamber V1, V2, V3 is varied by a shape of the inner peripheral surface 1332 of the cylinder 133 and an eccentricity of the roller 134, and refrigerant suctioned into the respective compression chamber V1, V2, V3 is compressed and discharged into an inner space of the casing 110 while moving along the roller 134 and the vane 1351, 1352, 1353. When the plurality of vanes 1351, 1352, 1353 is drawn out by the rotation of the roller 134 to come into contact with the inner peripheral surface of the cylinder 133, the plurality of vanes 1351, 1352, 1353 may be inclined due to a pressure difference between two sides thereof, and even when the vanes 1351, 1352, 1353 are inclined as one of upper and lower surfaces of the plurality of vanes 1351, 1352, 1353 is defined as the curved surface 1351*c*, 1351*d*, surface contact with the main/sub bearing 131, 132 may be allowed to increase leakage length, thereby preventing an oil film from being broken. Further, even when an inclination direction of the vane 1351, 1352, 1353 is changed, a direction change may be naturally allowed.

At least one of the upper and lower surfaces of the plurality of vanes 1351, 1352, 1353 is defined as the curved surface 1351*c* 1351*d*, and the groove portion 1317, 1327 is disposed on the main bearing 131 and the sub bearing 132 in contact with the curved surface 1351*c*, 1351*d* of the vanes 1351, 1352, 1353 so as to be connected to the curved surface 1351*c*, 1351*d* of the vanes 1351, 1352, 1353, and as a result, when the vanes 1351, 1352, 1353 rotate together with the roller 134, some oil is recovered from a portion between the vanes 1351, 1352, 1353 and the vane slots 1342*a*, 1342*b*, 1342, in which a hydraulic pressure increases, to reduce the hydraulic pressure, thereby improving an overall lubrication environment through the oil accumulated in the groove portion 1317, 1327.

In the rotary compressor according to embodiments disclosed herein, curvatures may be applied to upper and lower end surfaces of the vane, thereby allowing portions that have been in line contact between upper and lower ends of the vane and the bearings to come into surface contact. Further, in the rotary compressor according to embodiments disclosed herein, grooves may be provided on end surfaces of the bearings in contact with the upper and lower end surfaces of the vane to improve lubricating properties between the vane and the bearing during rotation of the vane, thereby minimizing loss. In addition, even when an inclination direction of the vane is changed, a direction change may be naturally induced.

Moreover, in the rotary compressor according to embodiments disclosed herein, curvatures may be applied to the upper and lower end surfaces of the vane, and grooves may be provided in the end surfaces of the bearing in contact therewith to increase a leakage length between the vane and the bearing, thereby preventing an oil film from being destroyed.

In the rotary compressor according to embodiments disclosed herein, the upper and lower surfaces of the vane are defined as curved surfaces, and groove portions are disposed on the main bearing and sub bearing in contact with the curved surfaces of the vane so as to be connected to the curved surfaces of the vane. When the vane rotates together with the rotor, some oil is recovered from a portion between the vane and the vane slot where a hydraulic pressure increases to reduce the hydraulic pressure, thereby improving an overall lubrication environment through the oil accumulated in the groove portions. In particular, as the main bearing provided at an upper end of the cylinder lacks an oil film, oil may be accommodated in the groove portion of the main bearing, thereby creating an improved lubrication environment than before.

Configurations and methods according to the above-described embodiments will not be applicable in a limited way to a lamp using the foregoing rotary compressor 100, and all or a portion of each embodiment may be selectively combined and configured to make various modifications thereto.

Embodiments disclosed herein are contrived to solve the foregoing problems, and provide a rotary compressor having a structure capable of inducing portions that have been in line contact between upper and lower ends of a vane and bearings to come into surface contact.

Further, embodiments disclosed herein provide a high-efficiency rotary compressor capable of improving lubricating properties between the vane and the bearings during the rotation of the vane, thereby minimizing loss.

Furthermore, embodiments disclosed herein provide a rotary compressor capable of reducing friction generated between a shaft and the vane rotating at high speed, and an end surface of the bearings fixed to maintain airtight sealing of a compression unit, thereby improving the efficiency and reliability of the rotary compressor.

Embodiments disclosed herein provide a rotary compressor having a structure capable of improving lubricating properties between the bearings and the vane during rotation of the vane. Embodiments disclosed herein also provide a rotary compressor having a structure capable of allowing surface contact due to a curvature even when the vane is tilted during rotation of the vane to increase leakage length, thereby preventing an oil film from being destroyed. In addition, embodiments disclosed herein provide a rotary compressor capable of recovering some oil to reduce hydraulic pressure in a portion where the vane is accommodated and changing an overall lubrication structure thereof.

Embodiments disclosed herein provide a rotary compressor that may include a cylinder having an inner peripheral surface in an annular shape to define a compression space, and provided with a suction port disposed in a lateral direction to communicate with the compression space to suction and provide refrigerant; a roller rotatably provided in the compression space of the cylinder, and provided with a plurality of vane slots providing a back pressure at one side thereinside at a predetermined interval along an outer peripheral surface; a plurality of vanes slidably inserted into the vane slots to rotate together with the roller, front end surfaces of which come into contact with an inner periphery of the cylinder by the back pressure to partition the compression space into a plurality of compression chambers; and a main bearing and a sub bearing provided at both ends of the cylinder to be in contact with both surfaces of the vane, respectively, and disposed to be spaced apart from each other to define both surfaces of the compression space, respectively. At least one surface of the vane in contact with the main bearing and the sub bearing is defined as a curved surface having a predetermined curvature. With this structure, curvatures may be applied to upper and lower end surfaces of the vane, thereby allowing portions that have been in line contact between upper and lower ends of the vane and the bearings to come into surface contact.

According to embodiments disclosed herein, a groove portion connected to a curved surface of the vane may be disposed on the main bearing and the sub bearing in contact with a surface of the vane during rotation of the vane. Grooves may be provided on end surfaces of the bearings in contact with the upper and lower end surfaces of the vane to improve lubricating properties between the vane and the bearing during rotation of the vane, thereby minimizing loss.

Further, a distance from both sides where a curvature starts on the curved surface of the vane to a tangent of the curvature may be greater than an assembly tolerance between a surface of the vane and the main bearing and the sub bearing, but less than or equal to 0.2 mm. The groove portion may have a depth greater than 0.1 mm but less than or equal to 5 mm.

The groove portion may be disposed to be spaced apart by a predetermined distance from outer peripheries of the main bearing and the sub bearing on one surface in contact with the surface of the vane during the rotation of the vane. Due to this, when the vane rotates together with the rotor, some oil is recovered from a portion between the vane and the vane slot where a hydraulic pressure increases to reduce the hydraulic pressure, thereby improving an overall lubrication environment through the oil accumulated in the groove portion.

According to embodiments disclosed herein, the main bearing may be provided at an upper end of the cylinder, and the groove portion may include a first portion provided on the main bearing in contact with one surface of the vane, and disposed in parallel to the upper end of the cylinder; and a second portion disposed to be connected to the first portion so as to intersect the first portion to define a side surface. As the main bearing provided at an upper end of the cylinder lacks an oil film, oil may be accommodated in the groove portion of the main bearing, thereby creating an improved lubrication environment than before.

Further, the sub bearing may be provided at a lower end of the cylinder, and the groove portion may include a third portion provided on the sub bearing in contact with one surface of the vane, and disposed in parallel to the upper end of the cylinder; and a fourth portion disposed to be connected to the third portion so as to intersect the third portion to define a side surface.

The groove portion may be defined in plurality. The plurality of groove portions may be disposed to be spaced apart from one another by a predetermined distance along a circumferential direction.

At least one back pressure pocket concavely disposed to communicate with the compression space may be provided on at least one of the main bearing or the sub bearing. The groove portion may be disposed to be spaced apart from the back pressure pocket.

The main bearing may include a main plate portion coupled to the cylinder to cover an upper side of the cylinder. The back pressure pocket may include a first main back pressure pocket disposed to be spaced apart from a lower surface of the main plate portion at a predetermined interval to define a discharge back pressure, and a second main back pressure pocket that defines an intermediate back pressure. The groove portion may be defined in plurality. The plurality of groove portions may be disposed along a circumferential direction to be spaced apart from the outer peripheries of the first main back pressure pocket and the second main back pressure pocket.

The groove portion may be defined in plurality, and the plurality of groove portions may be disposed to be spaced apart from one another by a predetermined distance along a circumferential direction. Some of the plurality of groove portions may be defined to be larger than the other groove portions, and the larger groove portions may be provided between the first and second main back pressure pockets.

According to embodiments disclosed herein, the sub bearing may include a sub plate portion coupled to the cylinder to cover a lower side of the cylinder. The back pressure pocket may include a first sub back pressure pocket disposed to be spaced apart from a lower surface of the sub plate portion at a predetermined interval to define a discharge back pressure, and a second sub back pressure pocket that defines an intermediate back pressure. The groove portion may be defined in plurality, and the plurality of groove portions may be disposed along a circumferential direction to be spaced apart from the outer peripheries of the first sub back pressure pocket and the second sub back pressure pocket.

The groove portion may be defined in plurality, and the plurality of groove portions may be disposed to be spaced apart from one another by a predetermined distance along a circumferential direction. Some of the plurality of groove portions may be defined to be larger than the other groove portions, and the larger groove portions may be provided between the first and second sub back pressure pockets.

In order to solve another foregoing problem, a rotary compressor according to embodiments disclosed herein may include a casing; a drive motor provided inside of the casing to generate rotational power; a cylinder having an inner peripheral surface defined in an annular shape to define a compression space, and provided with a suction port disposed in a lateral direction to communicate with the compression space to suction and provide refrigerant; a roller rotatably provided in the compression space of the cylinder, and provided with a plurality of vane slots providing a back pressure at one side thereinside at a predetermined interval along an outer peripheral surface; a plurality of vanes slidably inserted into the vane slots to rotate together with the roller, front end surfaces of which come into contact with an inner periphery of the cylinder by the back pressure to partition the compression space into a plurality of compression chambers; and a main bearing and a sub bearing provided at both ends of the cylinder to be in contact with both surfaces of the vane, respectively, and disposed to be spaced apart from each other to define both surfaces of the compression space, respectively, wherein at least one surface of the vane in contact with the main bearing and the sub bearing is defined as a curved surface having a predetermined curvature. With this structure, curvatures may be applied to upper and lower end surfaces of the vane, thereby allowing portions that have been in line contact between upper and lower ends of the vane and the bearings to come into surface contact.

Further, the drive motor may include a stator fixedly provided on an inner periphery of the casing; a rotor rotatably inserted into the stator; and a rotational shaft coupled to an inside of the rotor to rotate together with the rotor, and connected to the roller to transmit a rotational force allowing the roller to rotate. A groove portion connected to a curved surface of the vane may be disposed on the main bearing and the sub bearing in contact with a surface of the vane during rotation of the vane.

Grooves may be provided on end surfaces of the bearings in contact with upper and lower end surfaces of the vane to improve lubricating properties between the vane and the bearing during the rotation of the vane, thereby minimizing loss. Further, a distance from both sides where a curvature starts on the curved surface of the vane to a tangent of the curvature may be greater than an assembly tolerance between a surface of the vane and the main bearing and the sub bearing, but less than or equal to 0.2 mm. The groove portion may have a depth greater than 0.1 mm but less than or equal to 5 mm.

The groove portion may be disposed to be spaced apart by a predetermined distance from outer peripheries of the main bearing and the sub bearing on one surface in contact with the surface of the vane during the rotation of the vane. The groove portion may be defined in plurality, and the plurality of groove portions may be disposed to be spaced apart from one another by a predetermined distance along a circumferential direction.

At least one back pressure pocket concavely disposed to communicate with the compression space may be provided on at least one of the main bearing or the sub bearing. The groove portion may be disposed to be spaced apart from the back pressure pocket. Due to this, when the vane rotates together with the rotor, some oil is recovered from a portion between the vane and the vane slot where a hydraulic pressure increases to reduce the hydraulic pressure, thereby improving an overall lubrication environment through the oil accumulated in the groove portion.

The main bearing may include a main plate portion coupled to the cylinder to cover an upper side of the cylinder. The back pressure pocket may include a first main back pressure pocket disposed to be spaced apart from a lower surface of the main plate portion at a predetermined interval to define a discharge back pressure, and a second main back pressure pocket that defines an intermediate back pressure. The groove portion may be defined in plurality, and the plurality of groove portions may be disposed along a circumferential direction to be spaced apart from the outer peripheries of the first main back pressure pocket and the second main back pressure pocket.

The sub bearing may include a sub plate portion coupled to the cylinder to cover a lower side of the cylinder. The back pressure pocket may include a first sub back pressure pocket disposed to be spaced apart from a lower surface of the sub plate portion at a predetermined interval to define a discharge back pressure, and a second sub back pressure pocket that defines an intermediate back pressure. The groove portion may be disposed along a circumferential direction to be spaced apart from the outer peripheries of the first sub back pressure pocket and the second sub back pressure pocket.

It is obvious to those skilled in the art that embodiments may be embodied in other specific forms without departing from the concept and essential characteristics thereof. The above description is therefore to be construed in all aspects as illustrative and not restrictive. The scope should be determined by reasonable interpretation of the appended claims and all changes that come within the equivalent scope are included in the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a cylinder having an inner peripheral surface defined in an annular shape to define a compression space, and a suction port that extends in a lateral direction to communicate with the compression space and through which refrigerant is suctioned into the compression space;

a roller rotatably provided in the compression space of the cylinder, and having a plurality of vane slots that provides a back pressure at one side thereinside provided at a predetermined interval along an outer peripheral surface of the roller;

a plurality of vanes slidably inserted into the plurality of vane slots, respectively, to rotate together with the roller, front end surfaces of which come into contact with the inner peripheral surface of the cylinder due to the back pressure to partition the compression space into a plurality of compression chambers; and a main bearing and a sub bearing provided at ends of the cylinder and in contact with surfaces of the plurality of vanes, respectively, and spaced apart from each other to define surfaces of the compression space, respectively, wherein at least one surface of a respective vane of the plurality of vanes in contact with the main bearing and the sub bearing is a curved surface having a predetermined curvature.

2. The rotary compressor of claim 1, wherein a distance from both sides where a curvature starts on the curved surface of the respective vane to a tangent of the curvature is greater than an assembly tolerance between a surface of the respective vane and the main bearing and the sub bearing, but less than or equal to 0.2 mm.

3. The rotary compressor of claim 1, wherein at least one groove that faces the curved surface of the respective vane is disposed on the main bearing and the sub bearing in contact with a surface of the respective vane during rotation of the respective vane.

4. The rotary compressor of claim 3, wherein the at least one groove has a depth greater than 0.1 mm but less than or equal to 5 mm.

5. The rotary compressor of claim 3, wherein the at least one groove is spaced apart by a predetermined distance from outer peripheries of the main bearing and the sub bearing on the surface in contact with the surface of the one vane during rotation of the respective vane.

6. The rotary compressor of claim 5, wherein the at least one groove comprises a plurality of grooves spaced apart from one another by a predetermined distance along a circumferential direction.

7. The rotary compressor of claim 5, wherein at least one back pressure pocket concavely disposed to communicate with the compression space is provided on at least one of the main bearing or the sub bearing, and wherein the at least one groove is spaced apart from the at least one back pressure pocket.

8. The rotary compressor of claim 7, wherein the main bearing comprises a main plate portion coupled to the cylinder to cover an upper side of the cylinder, wherein the at least one back pressure pocket comprises a first main back pressure pocket spaced apart from a lower surface of the main plate portion at a predetermined interval to define a discharge back pressure, and a second main back pressure pocket that defines an intermediate back pressure, and wherein the at least one groove comprises a plurality of grooves disposed along a circumferential direction and spaced apart from outer peripheries of the first main back pressure pocket and the second main back pressure pocket.

9. The rotary compressor of claim 8, wherein some of the plurality of grooves is larger than the other grooves, and the larger grooves are provided between the first and second main back pressure pockets.

10. The rotary compressor of claim 8, wherein the sub bearing comprises a sub plate portion coupled to the cylinder to cover a lower side of the cylinder, wherein the back pressure pocket comprises a first sub back pressure pocket spaced apart from a lower surface of the sub plate portion at a predetermined interval to define a discharge back pressure, and a second sub back pressure pocket that defines an intermediate back pressure, and wherein the plurality of grooves is disposed along the circumferential direction and spaced apart from outer peripheries of the first sub back pressure pocket and the second sub back pressure pocket.

11. The rotary compressor of claim 10, wherein the plurality of grooves is spaced apart from one another by a predetermined distance along the circumferential direction, and wherein some of the plurality of grooves is larger than the other groove portions, and wherein the larger groove portions are provided between the first and second sub back pressure pockets.

12. The rotary compressor of claim 3, wherein the main bearing is provided at an upper end of the cylinder, and wherein the at least one groove comprises:

a first portion provided on the main bearing in contact with the surface of the respective vane, and extending in parallel to the upper end of the cylinder; and a second portion connected to the first portion so as to intersect the first portion to define a side surface.

13. The rotary compressor of claim 12, wherein the sub bearing is provided at a lower end of the cylinder, and wherein the at least one groove comprises:

a third portion provided on the sub bearing in contact with the surface of the respective vane, and extending in parallel to the lower end of the cylinder; and a fourth portion connected to the third portion so as to intersect the third portion to define a side surface.

14. A rotary compressor, comprising:

a casing;

a drive motor provided inside of the casing to generate rotational power;

a cylinder having an inner peripheral surface defined in an annular shape to define a compression space, and a suction port that extends in a lateral direction to communicate with the compression space and through which refrigerant is suctioned into the compression space;

a roller rotatably provided in the compression space of the cylinder, and having with a plurality of vane slots that provides a back pressure at one side thereinside provided at a predetermined interval along an outer peripheral surface of the roller;

a plurality of vanes slidably inserted into the plurality of vane slots, respectively, to rotate together with the roller, front end surfaces of which come into contact with the inner peripheral surface of the cylinder due to the back pressure to partition the compression space into a plurality of compression chambers; and a main bearing and a sub bearing provided at ends of the cylinder and in contact with surfaces of the plurality of vanes, respectively, and spaced apart from each other to define surfaces of the compression space, respectively, wherein at least one surface of a respective one of the plurality of vanes in contact with the main bearing and the sub bearing is a curved surface having a predetermined curvature.

15. The rotary compressor of claim 14, wherein the drive motor comprises:

a stator fixedly provided on an inner periphery of the casing;

a rotor rotatably inserted into the stator; and a rotational shaft coupled to an inside of the rotor to rotate together with the rotor, and connected to the roller to transmit a rotational force to rotate the roller.

16. The rotary compressor of claim 14, wherein at least one groove connected to that faces the curved surface of the respective vane is disposed on the main bearing and the sub bearing in contact with a surface of the respective vane during rotation of the respective vane.

17. The rotary compressor of claim 16, wherein the at least one groove portion is spaced apart by a predetermined distance from outer peripheries of the main bearing and the sub bearing on a surface in contact with the surface of the respective vane during rotation of the vane, and wherein the at least one groove comprises a plurality of grooves spaced apart from one another by a predetermined distance along a circumferential direction.

18. The rotary compressor of claim 17, wherein at least one back pressure pocket concavely disposed to communicate with the compression space is provided on at least one of the main bearing or the sub bearing, and wherein the at least one groove is spaced apart from the at least one back pressure pocket.

19. The rotary compressor of claim 18, wherein the main bearing comprises a main plate portion coupled to the cylinder to cover an upper side of the cylinder, wherein the back pressure pocket comprises a first main back pressure pocket spaced apart from a lower surface of the main plate portion at a predetermined interval to define a discharge back pressure, and a second main back pressure pocket that defines an intermediate back pressure, and wherein the plurality of grooves is disposed along a circumferential direction and spaced apart from outer peripheries of the first main back pressure pocket and the second main back pressure pocket.

20. The rotary compressor of claim 19, wherein the sub bearing comprises a sub plate portion coupled to the cylinder to cover a lower side of the cylinder, wherein the at least one back pressure pocket comprises a first sub back pressure pocket spaced apart from a lower surface of the sub plate portion at a predetermined interval to define a discharge back pressure, and a second sub back pressure pocket that defines an intermediate back pressure, and wherein the plurality of grooves is disposed along the circumferential direction to be spaced apart from outer peripheries of the first sub back pressure pocket and the second sub back pressure pocket.

* * * * *